US008230725B2

(12) United States Patent
Kim et al.

(10) Patent No.: US 8,230,725 B2
(45) Date of Patent: Jul. 31, 2012

(54) GOLF BALL

(75) Inventors: Hyoungchol Kim, Kobe (JP); Kaname Yamada, Kobe (JP); Masahide Onuki, Kobe (JP)

(73) Assignee: SRI Sports Limited, Kobe-Shi, Hyogo (JP)

( * ) Notice: Subject to any disclaimer, the term of this patent is extended or adjusted under 35 U.S.C. 154(b) by 217 days.

(21) Appl. No.: 12/776,002

(22) Filed: May 7, 2010

(65) Prior Publication Data

US 2010/0326175 A1 Dec. 30, 2010

(30) Foreign Application Priority Data

Jun. 30, 2009 (JP) ..... 2009-154494

(51) Int. Cl.
*A63B 53/00* (2006.01)

(52) U.S. Cl. ..... 73/65.03; 73/760

(58) Field of Classification Search ..... 73/760, 73/65.01–65.03

See application file for complete search history.

(56) References Cited

U.S. PATENT DOCUMENTS

| | | | | |
|---|---|---|---|---|
| 4,681,323 | A * | 7/1987 | Alaki et al. | 473/384 |
| 4,729,861 | A | 3/1988 | Lynch et al. | |
| 4,744,564 | A | 5/1988 | Yamada | |
| 4,936,587 | A | 6/1990 | Lynch et al. | |
| 5,080,367 | A | 1/1992 | Lynch et al. | |
| 5,356,150 | A * | 10/1994 | Lavallee et al. | 473/383 |
| 5,798,833 | A | 8/1998 | Onuki et al. | |
| 6,905,647 | B2 * | 6/2005 | Endo et al. | 264/248 |
| 7,041,012 | B2 * | 5/2006 | Iwami et al. | 473/378 |
| 7,066,841 | B2 * | 6/2006 | Sasaki et al. | 473/383 |
| 7,169,066 | B2 * | 1/2007 | Sajima | 473/383 |
| 7,254,492 | B2 * | 8/2007 | Miyamoto et al. | 702/44 |

FOREIGN PATENT DOCUMENTS

| | | | |
|---|---|---|---|
| JP | 50-8630 | A | 1/1975 |
| JP | 61-284264 | A | 12/1986 |
| JP | 9-68539 | A | 3/1997 |

OTHER PUBLICATIONS

Office Action dated Jul. 26, 2011 for corresponding Japanese Application No. 2009-154494.

* cited by examiner

*Primary Examiner* — Max Noori
(74) *Attorney, Agent, or Firm* — Birch, Stewart, Kolasch & Birch, LLP

(57) ABSTRACT

On the basis of a surface shape appearing at a predetermined point moment by moment during rotation of a golf ball having numerous dimples on its surface, a data constellation regarding a parameter dependent on a surface shape of the golf ball is calculated. A preferable parameter is a distance between an axis of the rotation and the surface of the golf ball. Another preferable parameter is a volume of space between a surface of a phantom sphere and the surface of the golf ball. Fourier transformation is performed on the data constellation to obtain a transformed data constellation. On the basis of a peak value and an order of a maximum peak of the transformed data constellation, an aerodynamic characteristic of the golf ball is determined. The peak value and the order of the maximum peak are calculated for each of PH rotation and POP rotation.

6 Claims, 27 Drawing Sheets

GOLF BALL

This application claims priority on Patent Application No. 2009-154494 filed in JAPAN on Jun. 30, 2009. The entire contents of this Japanese Patent Application are hereby incorporated by reference.

BACKGROUND OF THE INVENTION

1. Field of the Invention

The present invention relates to golf balls. Specifically, the present invention relates to improvement in dimples of golf balls.

2. Description of the Related Art

Golf balls have numerous dimples on the surface thereof. The dimples disturb the air flow around the golf ball during flight to cause turbulent flow separation. By causing the turbulent flow separation, separation points of the air from the golf ball shift backwards leading to a reduction of drag. The turbulent flow separation promotes the displacement between the separation point on the upper side and the separation point on the lower side of the golf ball, which results from the backspin, thereby enhancing the lift force that acts upon the golf ball. The reduction of drag and the enhancement of lift force are referred to as a "dimple effect".

The United States Golf Association (USGA) has established the rules about symmetry of golf balls. According to the rules, the trajectory during PH (pole horizontal) rotation and the trajectory during POP (pole over pole) rotation are compared with each other. A golf ball having a large difference between these two trajectories, that is, inferior aerodynamic symmetry, does not conform to the rules. A golf ball with inferior aerodynamic symmetry has a short flight distance because the aerodynamic characteristic of the golf ball for PH rotation or for POP rotation is inferior. The rotation axis for PH rotation extends through the poles of the golf ball, and the rotation axis for POP rotation is orthogonal to the rotation axis for PH rotation.

The dimples can be arranged by using a regular polyhedron that is inscribed in the phantom sphere of a golf ball. In this arrangement method, the surface of the phantom sphere is divided into a plurality of units by division lines obtained by projecting the sides of the polyhedron on the spherical surface. The dimple pattern of one unit is developed all over the phantom sphere. According to this dimple pattern, the aerodynamic characteristic in the case where a line passing through a vertex of the regular polyhedron is a rotation axis is different from that in the case where a line passing through the center of a surface of the regular polyhedron is a rotation axis. Such a golf ball has inferior aerodynamic symmetry.

JP-S50-8630 discloses a golf ball having an improved dimple pattern. The surface of the golf ball is divided by an icosahedron that is inscribed in the phantom sphere thereof. On the basis of this division, dimples are arranged on the surface of the golf ball. According to this dimple pattern, the number of great circles that do not intersect any dimples is 1. This great circle agrees with the equator of the golf ball. The region near the equator is a unique region.

Generally, a golf ball is formed by a mold having upper and lower mold halves. The mold has a parting line. A golf ball obtained by this mold has a seam at a position along the parting line. Through this forming process, spew occurs along the seam. The spew is removed by means of cutting. By cutting the spew, the dimples near the seam are deformed. In addition, the dimples near the seam tend to be orderly arranged. The seam is located along the equator of the golf ball. The region near the equator is a unique region.

A mold having an uneven parting line has been used. A golf ball obtained with this mold has dimples on the equator thereof. The dimples on the equator contribute to eliminating the uniqueness of the region near the equator. However, the uniqueness is not sufficiently eliminated. This golf ball has insufficient aerodynamic symmetry.

JP-S61-284264 discloses a golf ball in which the dimples near the seam are greater in volume than the dimples near the poles. This volume difference contributes to eliminating the uniqueness of the region near the equator.

The golf ball disclosed in JP-S61-284264 eliminates, by the volume difference of dimples, the disadvantage caused by the dimple pattern. The disadvantage is eliminated not by modification of the dimple pattern. In the golf ball, the potential of the dimple pattern is sacrificed. The flight distance of the golf ball is insufficient.

Research has been conducted to determine the causes of the uniqueness of the region near the equator, and the consequent insufficient symmetry and flight distance. However, the causes have not been clear yet, and a general theory for the improvements has not been established. In the conventional development of golf balls, design, experimental production, and evaluation are conducted through trials and errors.

An objective of the present invention is to provide a golf ball having excellent aerodynamic symmetry and a long flight distance. Another objective of the present invention is to provide a method for easily and accurately evaluating the aerodynamic characteristic of a golf ball.

SUMMARY OF THE INVENTION

As a result of thorough research, the inventors of the present invention have found that aerodynamic symmetry and a flight distance depend heavily on a specific parameter. On the basis of this finding, the inventors have established a method for evaluating a golf ball with high accuracy. In addition, by using the evaluation method, the inventors have completed creating a golf ball having excellent aerodynamic symmetry and a long flight distance.

A method for evaluating a golf ball according to the present invention comprises the steps of:

calculating a data constellation regarding a parameter dependent on a surface shape of a golf ball having numerous dimples on its surface, on the basis of a surface shape appearing at a predetermined point moment by moment during rotation of the golf ball;

performing Fourier transformation on the data constellation to obtain a transformed data constellation; and determining an aerodynamic characteristic of the golf ball on the basis of the transformed data constellation.

Preferably, at the determination step, the aerodynamic characteristic of the golf ball is determined on the basis of a peak value or an order of a maximum peak of the transformed data constellation. Preferably, at the calculation step, the data constellation is calculated throughout one rotation of the golf ball. Preferably, at the calculation step, the data constellation is calculated on the basis of a shape of a surface near a great circle orthogonal to an axis of the rotation. Preferably, at the calculation step, the data constellation is calculated on the basis of a parameter dependent on a distance between an axis of the rotation and the surface of the golf ball. At the calculation step, the data constellation may be calculated on the basis of a parameter dependent on a volume of space between a surface of a phantom sphere and the surface of the golf ball.

Another method for evaluating a golf ball according to the present invention comprises the steps of:

calculating a first data constellation regarding a parameter dependent on a surface shape of a golf ball having numerous dimples on its surface, on the basis of a surface shape appearing at a predetermined point moment by moment during rotation of the golf ball about a first axis;

calculating a second data constellation regarding a parameter dependent on the surface shape of the golf ball, on the basis of a surface shape appearing at a predetermined point moment by moment during rotation of the golf ball about a second axis;

performing Fourier transformation on the first data constellation to obtain a first transformed data constellation;

performing Fourier transformation on the second data constellation to obtain a second transformed data constellation; and determining an aerodynamic characteristic of the golf ball on the basis of comparison of the first transformed data constellation and the second transformed data constellation. Preferably, at the determination step, aerodynamic symmetry is determined.

A process for designing a golf ball according to the present invention comprises the steps of:

deciding positions and shapes of numerous dimples located on a surface of a golf ball;

calculating a data constellation regarding a parameter dependent on a surface shape of the golf ball, on the basis of a surface shape appearing at a predetermined point moment by moment during rotation of the golf ball;

performing Fourier transformation on the data constellation to obtain a transformed data constellation;

determining an aerodynamic characteristic of the golf ball on the basis of the transformed data constellation; and changing the positions or the shapes of the dimples when the aerodynamic characteristic is insufficient.

Preferably, at the determination step, the aerodynamic characteristic of the golf ball is determined on the basis of a peak value and an order of a maximum peak of the transformed data constellation. Preferably, at the calculation step, the data constellation is calculated throughout one rotation of the golf ball. Preferably, at the calculation step, the data constellation is calculated on the basis of a shape of a surface near a great circle orthogonal to an axis of the rotation. Preferably, at the calculation step, the data constellation is calculated on the basis of a parameter dependent on a distance between an axis of the rotation and the surface of the golf ball. At the calculation step, the data constellation may be calculated on the basis of a parameter dependent on a volume of space between a surface of a phantom sphere and the surface of the golf ball.

A golf ball according to the present invention has a peak value Pd1 and a peak value Pd2 each of which is equal to or less than 200 mm. The golf ball has an order Fd1 and an order Fd2 each of which is equal to or greater than 29 and equal to or less than 39. The peak values Pd1 and Pd2 and the orders Fd1 and Fd2 are obtained by the steps of:

(1) assuming a line connecting both poles of the golf ball as a first rotation axis;

(2) assuming a great circle which exists on a surface of a phantom sphere of the golf ball and is orthogonal to the first rotation axis;

(3) assuming two small circles which exist on the surface of the phantom sphere of the golf ball, which are orthogonal to the first rotation axis, and of which an absolute value of a central angle with the great circle is 30°;

(4) defining a region, of a surface of the golf ball, which is obtained by dividing the surface of the golf ball at the two small circles and which is sandwiched between the two small circles;

(5) determining 30240 points, on the region, arranged at intervals of a central angle of 3° in a direction of the first rotation axis and at intervals of a central angle of 0.25° in a direction of rotation about the first rotation axis;

(6) calculating a length L1 of a perpendicular line which extends from each point to the first rotation axis;

(7) calculating a total length L2 by summing 21 lengths L1 calculated on the basis of 21 perpendicular lines arranged in the direction of the first rotation axis;

(8) obtaining a first transformed data constellation by performing Fourier transformation on a first data constellation of 1440 total lengths L2 calculated along the direction of rotation about the first rotation axis;

(9) calculating the maximum peak Pd1 and the order Fd1 of the first transformed data constellation;

(10) assuming a second rotation axis orthogonal to the first rotation axis assumed at the step (1);

(11) assuming a great circle which exists on the surface of the phantom sphere of the golf ball and is orthogonal to the second rotation axis;

(12) assuming two small circles which exist on the surface of the phantom sphere of the golf ball, which are orthogonal to the second rotation axis, and of which an absolute value of a central angle with the great circle is 30°;

(13) defining a region, of the surface of the golf ball, which is obtained by dividing the surface of the golf ball at the two small circles and which is sandwiched between the two small circles;

(14) determining 30240 points, on the region, arranged at intervals of a central angle of 3° in a direction of the second rotation axis and at intervals of a central angle of 0.25° in a direction of rotation about the second rotation axis;

(15) calculating a length L1 of a perpendicular line which extends from each point to the second rotation axis;

(16) calculating a total length L2 by summing 21 lengths L1 calculated on the basis of 21 perpendicular lines arranged in the direction of the second rotation axis; and

(17) obtaining a second transformed data constellation by performing Fourier transformation on a second data constellation of 1440 total lengths L2 calculated along the direction of rotation about the second rotation axis; and

(18) calculating the peak value Pd2 and the order Fd2 of a maximum peak of the second transformed data constellation.

Preferably, an absolute value of a difference between the peak value Pd1 and the peak value Pd2 is equal to or less than 50 mm. Preferably, an absolute value of a difference between the order Fd1 and the order Fd2 is equal to or less than 10.

Another golf ball according to the present invention has a peak value Pd3 and a peak value Pd4 each of which is equal to or less than 20 $mm^3$. The golf ball has an order Fd3 and an order Fd4 each of which is equal to or greater than 29 and equal to or less than 35. The peak values Pd3 and Pd4 and the orders Fd3 and Fd4 are obtained by the steps of:

(1) assuming a line connecting both poles of the golf ball as a first rotation axis;

(2) assuming a great circle which exists on a surface of a phantom sphere of the golf ball and is orthogonal to the first rotation axis;

(3) assuming two small circles which exist on the surface of the phantom sphere of the golf ball, which are orthogonal to the first rotation axis, and of which an absolute value of a central angle with the great circle is 30°;

(4) defining a region, of a surface of the golf ball, which is obtained by dividing the surface of the golf ball at the two small circles and which is sandwiched between the two small circles;

(5) assuming 120 minute regions by dividing the region at an interval of a central angle of 3° in a direction of rotation about the first rotation axis;

(6) calculating a volume of space between the surface of the phantom sphere and the surface of the golf ball in each minute region;

(7) obtaining a first transformed data constellation by performing Fourier transformation on a first data constellation of the 120 volumes calculated along the direction of rotation about the first rotation axis;

(8) calculating the peak value Pd3 and the order Fd3 of a maximum peak of the first transformed data constellation;

(9) assuming a second rotation axis orthogonal to the first rotation axis assumed at the step (1);

(10) assuming a great circle which exists on the surface of the phantom sphere of the golf ball and is orthogonal to the second rotation axis;

(11) assuming two small circles which exist on the surface of the phantom sphere of the golf ball, which are orthogonal to the second rotation axis, and of which an absolute value of a central angle with the great circle is 30°;

(12) defining a region, of the surface of the golf ball, which is obtained by dividing the surface of the golf ball at the two small circles and which is sandwiched between the two small circles;

(13) assuming 120 minute regions by dividing the region at an interval of a central angle of 3° in a direction of rotation about the second rotation axis;

(14) calculating a volume of space between the surface of the phantom sphere and a surface of the golf ball in each minute region;

(15) obtaining a second transformed data constellation by performing Fourier transformation on a second data constellation of the 120 volumes calculated along the direction of rotation about the second rotation axis; and

(16) calculating the peak value Pd4 and the order Fd4 of a maximum peak of the second transformed data constellation.

Preferably, an absolute value of a difference between the peak value Pd3 and the peak value Pd4 is equal to or less than 5 $mm^3$. Preferably, an absolute value of a difference between the order Fd3 and the order Fd4 is equal to or less than 6.

DESCRIPTION OF THE PREFERRED EMBODIMENTS

The following will describe in detail the present invention based on preferred embodiments with reference to the accompanying drawings.

Figure 1:
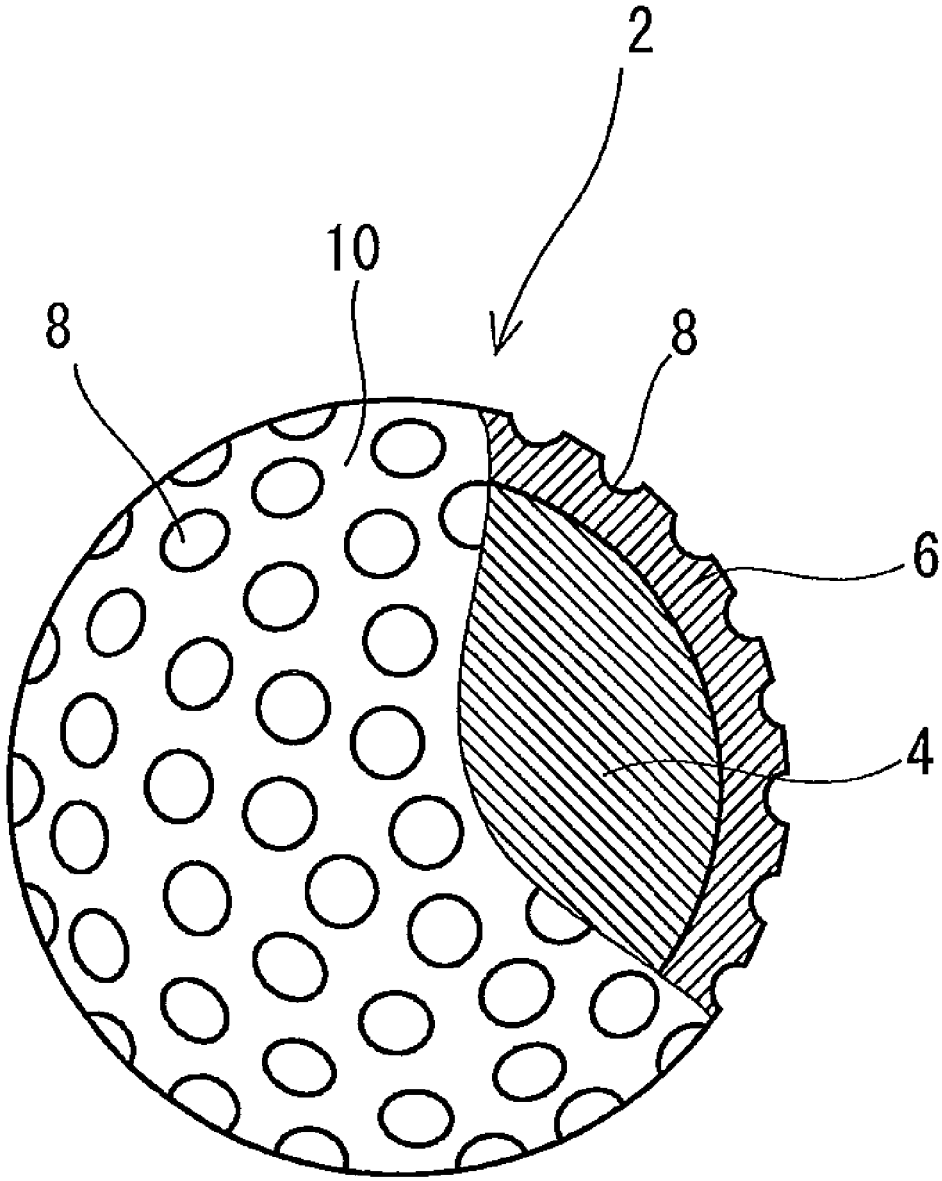
FIG. 1 is a schematic cross-sectional view of a golf ball according to one embodiment of the present invention.

A golf ball 2 shown in FIG. 1 includes a spherical core 4 and a cover 6. On the surface of the cover 6, numerous dimples 8 are formed. Of the surface of the golf ball 2, a part other than the dimples 8 is a land 10. The golf ball 2 includes a paint layer and a mark layer on the external side of the cover 6 although these layers are not shown in the drawing. A mid layer may be provided between the core 4 and the cover 6.

The diameter of the golf ball 2 is 40 mm or greater and 45 mm or less. From the standpoint of conformity to the rules established by the United States Golf Association (USGA), the diameter is more preferably 42.67 mm or greater. In light of suppression of air resistance, the diameter is more preferably 44 mm or less and particularly preferably 42.80 mm or less. The weight of the golf ball 2 is 40 g or greater and 50 g or less. In light of attainment of great inertia, the weight is more preferably 44 g or greater and particularly preferably 45.00 g or greater. From the standpoint of conformity to the rules established by the USGA, the weight is more preferably 45.93 g or less.

The core 4 is formed by crosslinking a rubber composition. Examples of base rubbers for use in the rubber composition include polybutadienes, polyisoprenes, styrene-butadiene copolymers, ethylene-propylene-diene copolymers, and natural rubbers. Two or more types of these rubbers may be used in combination. In light of resilience performance, polybutadienes are preferred, and in particular, high-cis polybutadienes are preferred.

In order to crosslink the core 4, a co-crosslinking agent can be used. Examples of preferable co-crosslinking agents in light of resilience performance include zinc acrylate, magnesium acrylate, zinc methacrylate, and magnesium methacrylate. Preferably, the rubber composition includes an organic peroxide together with a co-crosslinking agent. Examples of suitable organic peroxides include dicumyl peroxide, 1,1-bis (t-butylperoxy)-3,3,5-trimethylcyclohexane, 2,5-dimethyl-2, 5-di(t-butylperoxy)hexane, and di-t-butyl peroxide.

According to need, various additives such as a sulfur compound, a filler, an anti-aging agent, a coloring agent, a plasticizer, a dispersant, and the like are included in the rubber composition for the core 4 in an adequate amount. Crosslinked rubber powder or synthetic resin powder may be also included in the rubber composition.

The diameter of the core 4 is 30.0 mm or greater and particularly 38.0 mm or greater. The diameter of the core 4 is 42.0 mm or less and particularly 41.5 mm or less. The core 4 may be formed with two or more layers.

A suitable polymer for the cover 6 is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and ternary copolymer, preferable α-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion.

Instead of or together with an ionomer resin, other polymers may be used for the cover 6. Examples of the other polymers include thermoplastic polyurethane elastomers, thermoplastic styrene elastomers, thermoplastic polyamide elastomers, thermoplastic polyester elastomers, and thermoplastic polyolefin elastomers.

According to need, a coloring agent such as titanium dioxide, a filler such as barium sulfate, a dispersant, an antioxidant, an ultraviolet absorber, a light stabilizer, a fluorescent material, a fluorescent brightener, and the like are included in the cover 6 in an adequate amount. For the purpose of adjusting specific gravity, powder of a metal with a high specific gravity such as tungsten, molybdenum, and the like may be included in the cover 6.

The thickness of the cover 6 is 0.3 mm or greater and particularly 0.5 mm or greater. The thickness of the cover 6 is 2.5 mm or less and particularly 2.2 mm or less. The specific gravity of the cover 6 is 0.90 or greater and particularly 0.95 or greater. The specific gravity of the cover 6 is 1.10 or less and particularly 1.05 or less. The cover 6 may be formed with two or more layers.

Figure 2:
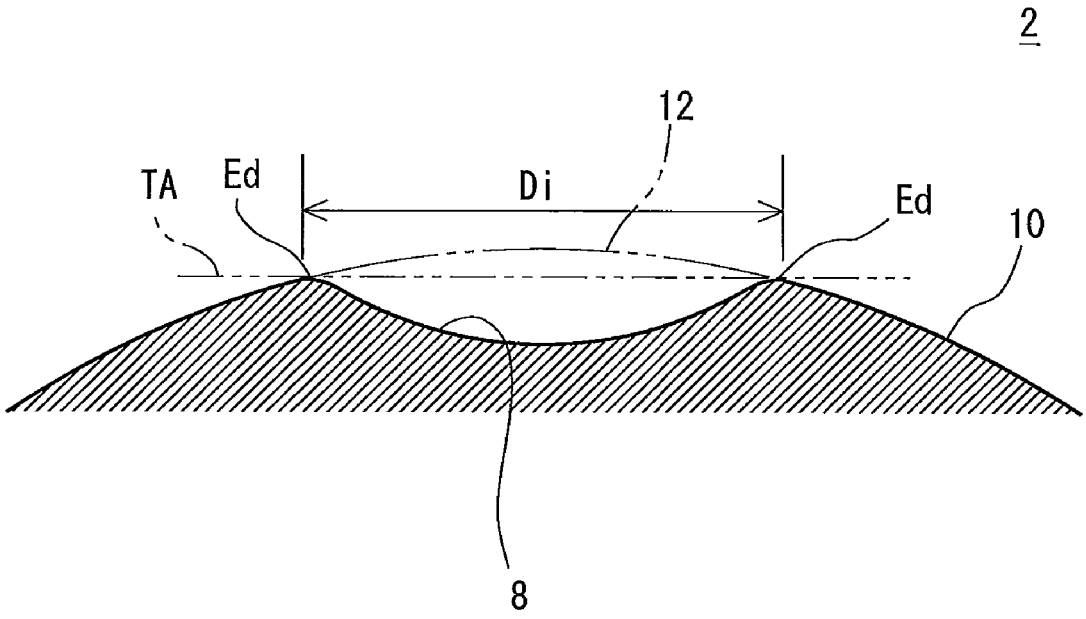
FIG. 2 is a partially enlarged cross-sectional view of the golf ball in FIG. 1.

FIG. 2 is a partially enlarged cross-sectional view of the golf ball 2 in FIG. 1. FIG. 2 shows a cross section along a plane passing through the center (deepest part) of the dimple 8 and the center of the golf ball 2. In FIG. 2, the top-to-bottom direction is the depth direction of the dimple 8. What is indicated by a chain double-dashed line in FIG. 2 is the surface of a phantom sphere 12. The surface of the phantom sphere 12 corresponds to the surface of the golf ball 2 when it is postulated that no dimple 8 exists. The dimple 8 is recessed from the surface of the phantom sphere 12. The land 10 agrees with the surface of the phantom sphere 12.

In FIG. 2, what is indicated by a double ended arrow Di is the diameter of the dimple 8. This diameter Di is the distance between two tangent points Ed appearing on a tangent line TA that is drawn tangent to the far opposite ends of the dimple 8. Each tangent point Ed is also the edge of the dimple 8. The edge Ed defines the contour of the dimple 8. The diameter Di is preferably 2.00 mm or greater and 6.00 mm or less. By setting the diameter Di to be equal to or greater than 2.00 mm, a superior dimple effect can be achieved. In this respect, the diameter Di is more preferably equal to or greater than 2.20 mm, and particularly preferably equal to or greater than 2.40 mm. By setting the diameter Di to be equal to or less than 6.00 mm, a fundamental feature of the golf ball 2 being substantially a sphere is not impaired. In this respect, the diameter Di is more preferably equal to or less than 5.80 mm, and particularly preferably equal to or less than 5.60 mm.

Figure 3:
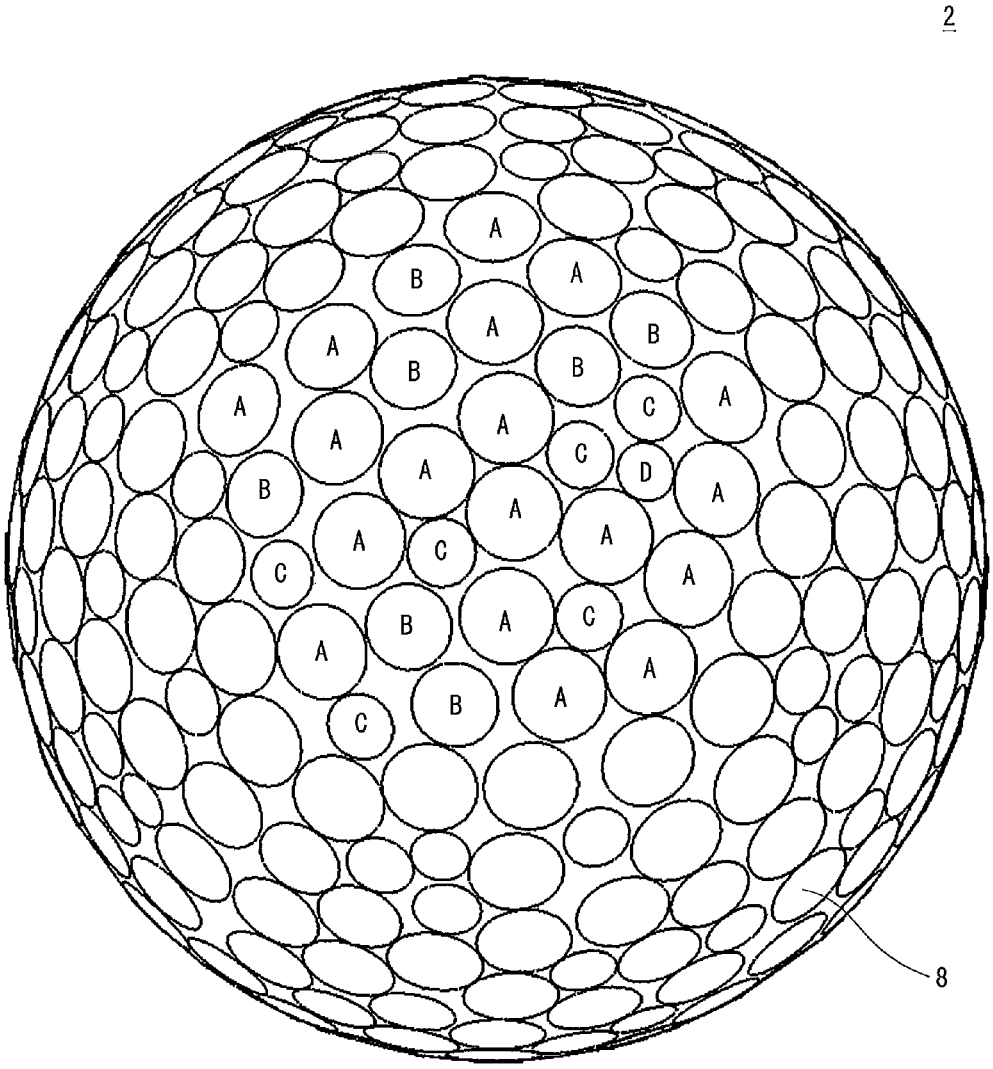
FIG. 3 is an enlarged front view of the golf ball in FIG. 1.
Figure 4:
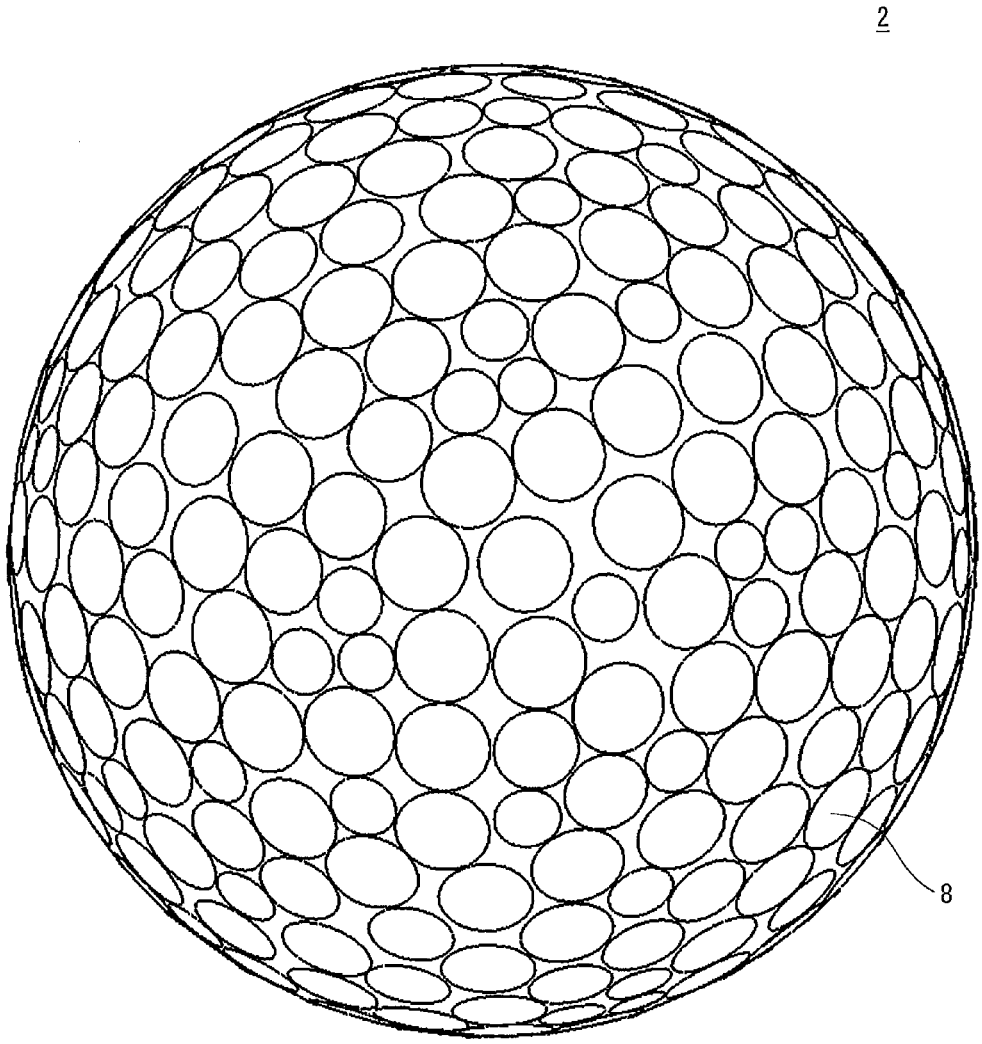
FIG. 4 is a plan view of the golf ball in FIG. 3.

FIG. 3 is an enlarged front view of the golf ball 2 in FIG. 1. FIG. 4 is a plan view of the golf ball 2 in FIG. 3. In FIG. 3, when the surface of the golf ball 2 is divided into 12 units, kinds of the dimples 8 in one unit are indicated by the reference signs A to D. All the dimples 8 have a circular plane shape. The golf ball 2 has dimples A with a diameter of 4.20 mm, dimples B with a diameter of 3.80 mm, dimples C with a diameter of 3.00 mm, and dimples D with a diameter of 2.60 mm. The dimple pattern of this unit is developed all over the surface of the golf ball 2. When developing the dimple pattern, the positions of the dimples 8 are fine adjusted for each unit. The number of the dimples A is 216; the number of the dimples B is 84; the number of the dimples C is 72; and the number of the dimples D is 12. The total number of the dimples 8 is 384. The latitude and longitude of these dimples 8 are shown in the following Tables 1 to 5.

TABLE 1

| Dimple Arrangement | | | |
|---|---|---|---|
| | Kind | Latitude (degree) | Longitude (degree) |
| 1 | A | 85.691 | 67.318 |
| 2 | A | 81.286 | 199.300 |
| 3 | A | 81.286 | 280.700 |
| 4 | A | 75.987 | 334.897 |
| 5 | A | 75.987 | 145.103 |
| 6 | A | 75.303 | 23.346 |
| 7 | A | 71.818 | 100.896 |
| 8 | A | 65.233 | 133.985 |
| 9 | A | 65.233 | 346.015 |
| 10 | A | 65.189 | 39.055 |
| 11 | A | 65.060 | 75.516 |
| 12 | A | 61.445 | 158.091 |
| 13 | A | 61.445 | 321.909 |
| 14 | A | 61.070 | 252.184 |
| 15 | A | 61.070 | 227.816 |
| 16 | A | 60.847 | 108.080 |
| 17 | A | 57.147 | 58.461 |
| 18 | A | 55.279 | 288.525 |
| 19 | A | 55.279 | 191.475 |
| 20 | A | 54.062 | 211.142 |
| 21 | A | 54.062 | 268.858 |
| 22 | A | 54.041 | 350.081 |
| 23 | A | 53.504 | 126.971 |
| 24 | A | 53.069 | 307.598 |
| 25 | A | 53.069 | 172.402 |
| 26 | A | 49.772 | 228.202 |
| 27 | A | 49.526 | 107.190 |
| 28 | A | 49.456 | 249.324 |
| 29 | A | 47.660 | 15.660 |
| 30 | A | 47.244 | 67.559 |

TABLE 1-continued

| Dimple Arrangement | | | |
|---|---|---|---|
| | Kind | Latitude (degree) | Longitude (degree) |
| 31 | A | 46.729 | 50.974 |
| 32 | A | 46.350 | 323.515 |
| 33 | A | 46.350 | 156.485 |
| 34 | A | 45.673 | 34.636 |
| 35 | A | 44.933 | 339.633 |
| 36 | A | 44.933 | 140.367 |
| 37 | A | 44.882 | 295.495 |
| 38 | A | 44.882 | 184.505 |
| 39 | A | 44.242 | 359.196 |
| 40 | A | 42.196 | 120.253 |
| 41 | A | 40.522 | 237.865 |
| 42 | A | 36.705 | 73.432 |
| 43 | A | 36.500 | 11.475 |
| 44 | A | 36.079 | 45.962 |
| 45 | A | 35.806 | 193.343 |
| 46 | A | 35.806 | 286.657 |
| 47 | A | 35.713 | 250.884 |
| 48 | A | 35.005 | 131.984 |
| 49 | A | 34.833 | 177.642 |
| 50 | A | 34.833 | 302.358 |
| 51 | A | 34.560 | 207.408 |
| 52 | A | 34.560 | 272.592 |
| 53 | A | 33.900 | 86.867 |
| 54 | A | 30.252 | 359.718 |
| 55 | A | 30.080 | 119.572 |
| 56 | A | 29.307 | 239.817 |
| 57 | A | 26.977 | 337.630 |
| 58 | A | 26.967 | 217.628 |
| 59 | A | 26.522 | 53.578 |
| 60 | A | 26.233 | 313.918 |
| 61 | A | 26.233 | 166.082 |
| 62 | A | 25.945 | 77.590 |
| 63 | A | 25.668 | 199.232 |
| 64 | A | 25.668 | 280.768 |
| 65 | A | 25.588 | 40.979 |
| 66 | A | 23.737 | 107.042 |
| 67 | A | 22.987 | 91.662 |
| 68 | A | 20.802 | 269.276 |
| 69 | A | 20.537 | 29.857 |
| 70 | A | 19.971 | 149.439 |
| 71 | A | 18.932 | 325.930 |
| 72 | A | 18.877 | 118.043 |
| 73 | A | 18.548 | 209.356 |
| 74 | A | 17.974 | 1.141 |
| 75 | A | 17.973 | 241.141 |
| 76 | A | 16.138 | 138.223 |
| 77 | A | 15.811 | 220.861 |
| 78 | A | 15.723 | 161.053 |
| 79 | A | 15.558 | 340.213 |
| 80 | A | 15.057 | 54.091 |

TABLE 2

| Dimple Arrangement | | | |
|---|---|---|---|
| | Kind | Latitude (degree) | Longitude (degree) |
| 81 | A | 15.011 | 66.203 |
| 82 | A | 14.992 | 186.255 |
| 83 | A | 14.535 | 312.879 |
| 84 | A | 14.152 | 282.171 |
| 85 | A | 14.107 | 77.896 |
| 86 | A | 14.065 | 197.945 |
| 87 | A | 11.930 | 127.300 |
| 88 | A | 11.464 | 351.579 |
| 89 | A | 11.459 | 231.583 |
| 90 | A | 9.454 | 267.333 |
| 91 | A | 9.446 | 27.328 |
| 92 | A | 8.895 | 147.125 |
| 93 | A | 7.578 | 116.668 |
| 94 | A | 6.950 | 301.950 |

TABLE 2-continued

| Dimple Arrangement | | | |
|---|---|---|---|
| | Kind | Latitude (degree) | Longitude (degree) |
| 95 | A | 6.664 | 2.030 |
| 96 | A | 6.663 | 242.035 |
| 97 | A | 5.164 | 289.168 |
| 98 | A | 4.715 | 158.076 |
| 99 | A | 4.699 | 71.498 |
| 100 | A | 4.677 | 38.046 |
| 101 | A | 4.670 | 191.529 |
| 102 | A | 4.386 | 169.415 |
| 103 | A | 4.370 | 49.384 |
| 104 | A | 4.189 | 104.832 |
| 105 | A | 3.868 | 253.091 |
| 106 | A | 3.866 | 13.085 |
| 107 | A | 3.702 | 277.673 |
| 108 | A | 3.284 | 343.658 |
| 109 | A | 3.276 | 223.664 |
| 110 | A | −1.138 | 263.313 |
| 111 | A | −1.145 | 23.305 |
| 112 | A | −3.156 | 296.805 |
| 113 | A | −3.730 | 117.727 |
| 114 | A | −5.028 | 98.222 |
| 115 | A | −5.301 | 66.255 |
| 116 | A | −5.320 | 186.266 |
| 117 | A | −5.560 | 1.243 |
| 118 | A | −5.562 | 241.252 |
| 119 | A | −5.603 | 174.914 |
| 120 | A | −5.608 | 54.904 |
| 121 | A | −6.610 | 77.578 |
| 122 | A | −6.651 | 197.586 |
| 123 | A | −6.740 | 316.100 |
| 124 | A | −9.310 | 219.881 |
| 125 | A | −9.379 | 327.238 |
| 126 | A | −9.834 | 338.778 |
| 127 | A | −11.302 | 139.305 |
| 128 | A | −11.465 | 304.650 |
| 129 | A | −11.656 | 258.951 |
| 130 | A | −11.661 | 18.940 |
| 131 | A | −13.404 | 89.766 |
| 132 | A | −13.611 | 208.915 |
| 133 | A | −13.916 | 293.296 |
| 134 | A | −14.848 | 128.252 |
| 135 | A | −14.902 | 247.791 |
| 136 | A | −14.902 | 7.778 |
| 137 | A | −14.989 | 104.117 |
| 138 | A | −15.045 | 116.532 |
| 139 | A | −15.350 | 60.821 |
| 140 | A | −15.357 | 180.810 |
| 141 | A | −15.509 | 150.296 |
| 142 | A | −15.563 | 30.304 |
| 143 | A | −15.581 | 281.633 |
| 144 | A | −16.386 | 269.878 |
| 145 | A | −20.645 | 328.793 |
| 146 | A | −21.042 | 311.017 |
| 147 | A | −23.090 | 19.912 |
| 148 | A | −23.809 | 172.748 |
| 149 | A | −23.819 | 52.779 |
| 150 | A | −24.625 | 69.349 |
| 151 | A | −24.650 | 189.318 |
| 152 | A | −25.075 | 261.401 |
| 153 | A | −25.417 | 133.803 |
| 154 | A | −25.453 | 156.111 |
| 155 | A | −25.495 | 36.142 |
| 156 | A | −25.836 | 276.531 |
| 157 | A | −25.899 | 100.191 |
| 158 | A | −26.295 | 4.604 |
| 159 | A | −26.501 | 351.270 |
| 160 | A | −26.527 | 248.419 |

TABLE 3

| Dimple Arrangement | | | |
|---|---|---|---|
| | Kind | Latitude (degree) | Longitude (degree) |
| 161 | A | −28.009 | 338.630 |
| 162 | A | −28.872 | 320.134 |
| 163 | A | −29.656 | 216.752 |
| 164 | A | −33.266 | 165.532 |
| 165 | A | −33.289 | 45.587 |
| 166 | A | −33.571 | 26.465 |
| 167 | A | −34.810 | 121.946 |
| 168 | A | −34.881 | 92.123 |
| 169 | A | −35.921 | 70.481 |
| 170 | A | −35.948 | 190.419 |
| 171 | A | −35.969 | 106.249 |
| 172 | A | −36.237 | 241.545 |
| 173 | A | −36.677 | 269.561 |
| 174 | A | −36.780 | 309.211 |
| 175 | A | −38.058 | 3.003 |
| 176 | A | −40.005 | 57.051 |
| 177 | A | −41.376 | 295.414 |
| 178 | A | −41.680 | 176.151 |
| 179 | A | −42.945 | 217.442 |
| 180 | A | −44.210 | 21.410 |
| 181 | A | −44.278 | 258.399 |
| 182 | A | −44.396 | 320.927 |
| 183 | A | −44.500 | 159.270 |
| 184 | A | −44.941 | 115.286 |
| 185 | A | −44.961 | 279.798 |
| 186 | A | −46.360 | 142.796 |
| 187 | A | −48.437 | 243.048 |
| 188 | A | −49.314 | 5.102 |
| 189 | A | −49.778 | 68.092 |
| 190 | A | −50.602 | 188.133 |
| 191 | A | −52.599 | 226.337 |
| 192 | A | −52.972 | 309.720 |
| 193 | A | −52.982 | 127.612 |
| 194 | A | −53.185 | 348.010 |
| 195 | A | −53.519 | 169.798 |
| 196 | A | −54.005 | 207.538 |
| 197 | A | −54.153 | 290.081 |
| 198 | A | −54.419 | 88.781 |
| 199 | A | −54.511 | 328.756 |
| 200 | A | −55.417 | 108.606 |
| 201 | A | −56.454 | 49.583 |
| 202 | A | −59.768 | 242.157 |
| 203 | A | −60.664 | 3.667 |
| 204 | A | −61.192 | 142.183 |
| 205 | A | −61.580 | 72.132 |
| 206 | A | −62.555 | 192.606 |
| 207 | A | −63.591 | 27.254 |
| 208 | A | −64.742 | 166.150 |
| 209 | A | −71.117 | 239.508 |
| 210 | A | −71.895 | 0.773 |
| 211 | A | −73.954 | 321.276 |
| 212 | A | −75.160 | 276.770 |
| 213 | A | −75.592 | 156.215 |
| 214 | A | −81.496 | 104.116 |
| 215 | A | −83.209 | 358.182 |
| 216 | A | −83.703 | 222.567 |
| 217 | B | 71.726 | 222.962 |
| 218 | B | 71.726 | 257.038 |
| 219 | B | 65.062 | 12.846 |
| 220 | B | 64.201 | 204.125 |
| 221 | B | 64.201 | 275.875 |
| 222 | B | 56.523 | 25.705 |
| 223 | B | 44.733 | 202.702 |
| 224 | B | 44.733 | 277.298 |
| 225 | B | 44.730 | 82.887 |
| 226 | B | 42.191 | 217.140 |
| 227 | B | 42.191 | 262.860 |
| 228 | B | 41.735 | 96.344 |
| 229 | B | 36.680 | 330.394 |
| 230 | B | 36.680 | 149.606 |
| 231 | B | 36.636 | 317.227 |
| 232 | B | 36.636 | 162.773 |
| 233 | B | 36.073 | 348.257 |
| 234 | B | 35.785 | 60.068 |
| 235 | B | 35.768 | 108.197 |

TABLE 3-continued

| Dimple Arrangement | | | |
|---|---|---|---|
| | Kind | Latitude (degree) | Longitude (degree) |
| 236 | B | 34.642 | 226.451 |
| 237 | B | 33.690 | 32.733 |
| 238 | B | 29.217 | 21.434 |
| 239 | B | 28.939 | 260.890 |
| 240 | B | 28.206 | 141.817 |

TABLE 4

| Dimple Arrangement | | | |
|---|---|---|---|
| | Kind | Latitude (degree) | Longitude (degree) |
| 241 | B | 26.112 | 65.597 |
| 242 | B | 26.015 | 292.775 |
| 243 | B | 26.015 | 187.225 |
| 244 | B | 24.460 | 250.577 |
| 245 | B | 24.459 | 10.579 |
| 246 | B | 24.275 | 130.633 |
| 247 | B | 24.145 | 349.181 |
| 248 | B | 24.139 | 229.180 |
| 249 | B | 15.512 | 293.264 |
| 250 | B | 15.320 | 173.775 |
| 251 | B | 14.775 | 41.979 |
| 252 | B | 13.715 | 99.702 |
| 253 | B | 8.740 | 331.201 |
| 254 | B | 8.205 | 212.585 |
| 255 | B | 6.028 | 60.110 |
| 256 | B | 6.022 | 180.144 |
| 257 | B | 5.563 | 136.285 |
| 258 | B | 4.862 | 93.872 |
| 259 | B | 4.358 | 82.630 |
| 260 | B | 4.307 | 202.659 |
| 261 | B | 3.795 | 313.779 |
| 262 | B | 0.913 | 323.942 |
| 263 | B | −1.407 | 143.793 |
| 264 | B | −4.880 | 163.968 |
| 265 | B | −4.907 | 43.957 |
| 266 | B | −5.030 | 284.024 |
| 267 | B | −5.184 | 153.695 |
| 268 | B | −5.231 | 33.684 |
| 269 | B | −6.134 | 273.262 |
| 270 | B | −6.841 | 230.478 |
| 271 | B | −6.845 | 349.569 |
| 272 | B | −15.871 | 235.789 |
| 273 | B | −16.146 | 354.934 |
| 274 | B | −18.714 | 79.067 |
| 275 | B | −18.758 | 199.051 |
| 276 | B | −23.971 | 288.774 |
| 277 | B | −26.108 | 112.218 |
| 278 | B | −26.223 | 236.362 |
| 279 | B | −29.185 | 80.517 |
| 280 | B | −29.232 | 200.478 |
| 281 | B | −33.697 | 285.117 |
| 282 | B | −34.334 | 228.527 |
| 283 | B | −35.520 | 150.290 |
| 284 | B | −36.149 | 330.142 |
| 285 | B | −36.438 | 136.825 |
| 286 | B | −41.409 | 35.857 |
| 287 | B | −42.609 | 82.467 |
| 288 | B | −43.798 | 200.849 |
| 289 | B | −45.001 | 97.037 |
| 290 | B | −45.076 | 336.769 |
| 291 | B | −51.775 | 32.952 |
| 292 | B | −63.684 | 311.963 |
| 293 | B | −64.471 | 216.578 |
| 294 | B | −64.482 | 96.287 |
| 295 | B | −64.561 | 336.711 |
| 296 | B | −64.843 | 263.144 |
| 297 | B | −64.922 | 287.410 |
| 298 | B | −72.192 | 77.689 |
| 299 | B | −73.119 | 198.413 |

TABLE 4-continued

| Dimple Arrangement | | | |
|---|---|---|---|
| | Kind | Latitude (degree) | Longitude (degree) |
| 300 | B | −74.983 | 38.997 |
| 301 | C | 74.657 | 63.484 |
| 302 | C | 71.768 | 190.178 |
| 303 | C | 71.768 | 289.822 |
| 304 | C | 62.942 | 179.469 |
| 305 | C | 62.942 | 300.531 |
| 306 | C | 56.191 | 7.848 |
| 307 | C | 55.053 | 77.053 |
| 308 | C | 54.553 | 41.717 |
| 309 | C | 53.846 | 333.327 |
| 310 | C | 53.846 | 146.673 |
| 311 | C | 51.471 | 92.182 |
| 312 | C | 43.387 | 308.955 |
| 313 | C | 43.387 | 171.045 |
| 314 | C | 39.782 | 24.035 |
| 315 | C | 30.483 | 99.122 |
| 316 | C | 28.904 | 324.540 |
| 317 | C | 28.904 | 155.460 |
| 318 | C | 25.096 | 177.021 |
| 319 | C | 25.096 | 302.979 |
| 320 | C | 19.173 | 19.184 |

TABLE 5

| Dimple Arrangement | | | |
|---|---|---|---|
| | Kind | Latitude (degree) | Longitude (degree) |
| 321 | C | 19.031 | 258.510 |
| 322 | C | 16.665 | 302.816 |
| 323 | C | 13.992 | 109.225 |
| 324 | C | 13.490 | 250.202 |
| 325 | C | 13.489 | 10.199 |
| 326 | C | 13.283 | 88.625 |
| 327 | C | 9.824 | 321.654 |
| 328 | C | 2.241 | 125.798 |
| 329 | C | 1.894 | 353.532 |
| 330 | C | 1.889 | 233.538 |
| 331 | C | −0.688 | 333.972 |
| 332 | C | −0.779 | 214.792 |
| 333 | C | −1.916 | 306.499 |
| 334 | C | −3.246 | 133.810 |
| 335 | C | −3.817 | 86.960 |
| 336 | C | −3.875 | 206.975 |
| 337 | C | −5.619 | 108.070 |
| 338 | C | −5.643 | 251.068 |
| 339 | C | −5.645 | 11.059 |
| 340 | C | −13.167 | 160.039 |
| 341 | C | −13.201 | 40.044 |
| 342 | C | −13.992 | 70.775 |
| 343 | C | −14.020 | 190.767 |
| 344 | C | −14.119 | 169.982 |
| 345 | C | −14.134 | 49.990 |
| 346 | C | −15.855 | 319.691 |
| 347 | C | −18.820 | 342.978 |
| 348 | C | −19.621 | 218.069 |
| 349 | C | −20.962 | 227.066 |
| 350 | C | −21.132 | 300.259 |
| 351 | C | −23.321 | 88.424 |
| 352 | C | −23.382 | 208.402 |
| 353 | C | −24.157 | 122.583 |
| 354 | C | −25.238 | 144.976 |
| 355 | C | −30.175 | 296.333 |
| 356 | C | −30.604 | 60.620 |
| 357 | C | −30.611 | 180.571 |
| 358 | C | −33.028 | 14.319 |
| 359 | C | −35.296 | 253.537 |
| 360 | C | −36.369 | 208.069 |
| 361 | C | −37.100 | 342.734 |
| 362 | C | −43.286 | 128.706 |
| 363 | C | −43.365 | 231.100 |

TABLE 5-continued

| Dimple Arrangement | | | |
|---|---|---|---|
| | Kind | Latitude (degree) | Longitude (degree) |
| 364 | C | −43.751 | 352.045 |
| 365 | C | −46.901 | 46.162 |
| 366 | C | −53.473 | 153.219 |
| 367 | C | −54.282 | 257.158 |
| 368 | C | −54.735 | 18.268 |
| 369 | C | −57.211 | 273.655 |
| 370 | C | −62.936 | 120.983 |
| 371 | C | −66.376 | 49.500 |
| 372 | C | −71.885 | 110.989 |
| 373 | D | 69.657 | 168.114 |
| 374 | D | 69.657 | 311.886 |
| 375 | D | 58.920 | 90.139 |
| 376 | D | 11.497 | 258.235 |
| 377 | D | 11.492 | 18.232 |
| 378 | D | −5.801 | 126.695 |
| 379 | D | −19.739 | 163.893 |
| 380 | D | −19.766 | 43.912 |
| 381 | D | −28.169 | 304.659 |
| 382 | D | −35.660 | 351.929 |
| 383 | D | −50.268 | 268.667 |
| 384 | D | −69.514 | 132.796 |

From the standpoint that the individual dimples 8 can contribute to the dimple effect, the average diameter of the dimples 8 is preferably equal to or greater than 3.5 mm, and more preferably equal to or greater than 3.8 mm. The average diameter is preferably equal to or less than 5.50 mm. By setting the average diameter to be equal to or less than 5.50 mm, the fundamental feature of the golf ball 2 being substantially a sphere is not impaired. The golf ball 2 shown in FIGS. 3 and 4 has an average diameter of 3.84 mm.

The area S of the dimple 8 is the area of a region surrounded by the contour line when the center of the golf ball 2 is viewed at infinity. In the case of a circular dimple 8, the area S is calculated by the following formula.

$$S=(Di/2)^2*\pi$$

In the golf ball 2 shown in FIGS. 3 and 4, the area of the dimple A is 13.85 $mm^2$; the area of the dimple B is 11.34 $mm^2$; the area of the dimple C is 7.07 $mm^2$; and the area of the dimple D is 5.31 $mm^2$.

In the present invention, the ratio of the sum of the areas S of all the dimples 8 to the surface area of the phantom sphere 12 is referred to as an occupation ratio. From the standpoint that a sufficient dimple effect is achieved, the occupation ratio is preferably equal to or greater than 70%, more preferably equal to or greater than 74%, and particularly preferably equal to or greater than 78%. The occupation ratio is preferably equal to or less than 95%. In the golf ball 2 shown in FIGS. 3 and 4, the total area of the dimples 8 is 4516.9 $mm^2$. The surface area of the phantom sphere 12 of the golf ball 2 is 5728.0 $mm^2$, and thus the occupation ratio is 79%.

In light of suppression of rising of the golf ball 2 during flight, the depth of the dimple 8 is preferably equal to or greater than 0.05 mm, more preferably equal to or greater than 0.08 mm, and particularly preferably equal to or greater than 0.10 mm. In light of suppression of dropping of the golf ball 2 during flight, the depth of the dimple 8 is preferably equal to or less than 0.60 mm, more preferably equal to or less than 0.45 mm, and particularly preferably equal to or less than 0.40 mm. The depth is the distance between the tangent line TA and the deepest part of the dimple 8.

In the present invention, the term "dimple volume" means the volume of a part surrounded by the surface of the dimple 8 and a plane that includes the contour of the dimple 8. In light of suppression of rising of the golf ball 2 during flight, the sum of the volumes (total volume) of all the dimples 8 is preferably equal to or greater than 240 $mm^3$, more preferably equal to or greater than 260 $mm^3$, and particularly preferably equal to or greater than 280 $mm^3$. In light of suppression of dropping of the golf ball 2 during flight, the total volume is preferably equal to or less than 400 $mm^3$, more preferably equal to or less than 380 $mm^3$, and particularly preferably equal to or less than 360 $mm^3$.

From the standpoint that a sufficient occupation ratio can be achieved, the total number of the dimples 8 is preferably equal to or greater than 200, more preferably equal to or greater than 250, and particularly preferably equal to or greater than 300. From the standpoint that the individual dimples 8 can have a sufficient diameter, the total number is preferably equal to or less than 500, more preferably equal to or less than 440, and particularly preferably equal to or less than 400.

Figure 5:
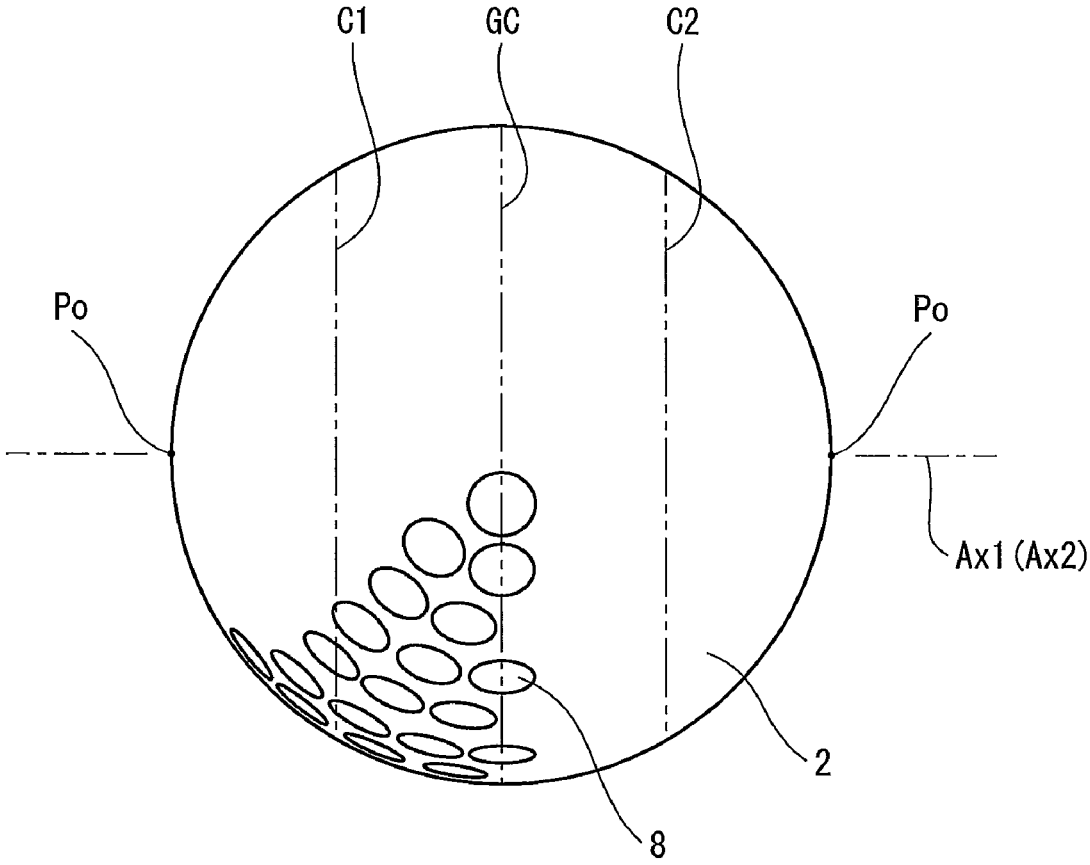
FIG. 5 is a schematic view for explaining an evaluation method according to one embodiment of the present invention.

The following will describe an evaluation method for aerodynamic characteristic according to the present invention. FIG. 5 is a schematic view for explaining the evaluation method. In the evaluation method, a first rotation axis Ax1 is assumed. The first rotation axis Ax1 passes through the two poles Po of the golf ball 2. Each pole Po corresponds to a deepest part of a mold used for forming the golf ball 2. One of the poles Po corresponds to the deepest part of an upper mold half, and the other pole Po corresponds to the deepest part of a lower mold half. The golf ball 2 rotates about the first rotation axis Ax1. This rotation is referred to as PH rotation.

Figure 6:
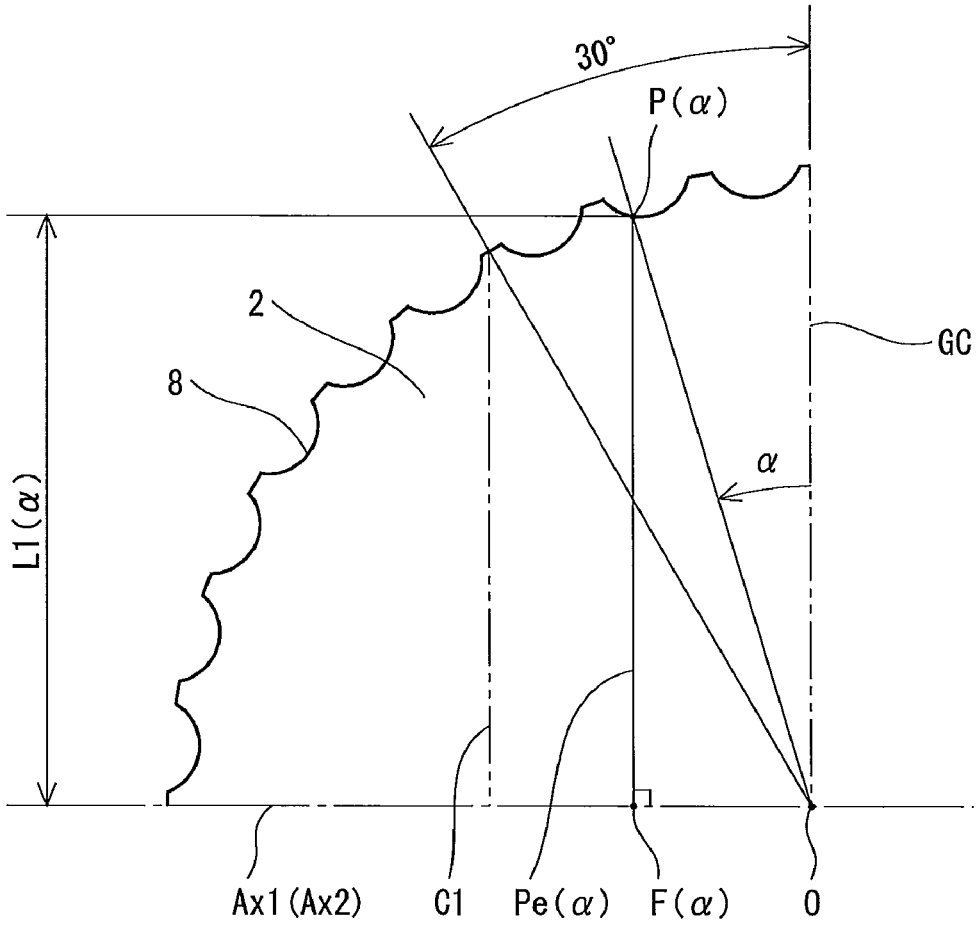
FIG. 6 is a schematic view for explaining the evaluation method in FIG. 5.

There is assumed a great circle GC that exists on the surface of the phantom sphere 12 of the golf ball 2 and is orthogonal to the first rotation axis Ax1. The circumferential speed of the great circle GC is faster than any other part of the golf ball 2 during rotation of the golf ball 2. In addition, there are assumed two small circles C1 and C2 that exist on the surface of the phantom sphere 12 of the golf ball 2 and are orthogonal to the first rotation axis Ax1. FIG. 6 schematically shows a partial cross-sectional view of the golf ball 2 in FIG. 5. In FIG. 6, the right-to-left direction is the direction of the first rotation axis Ax1. As shown in FIG. 6, the absolute value of the central angle between the small circle C1 and the great circle GC is 30°. Although not shown in the drawing, the absolute value of the central angle between the small circle C2 and the great circle GC is also 30°. The golf ball 2 is divided at the small circles C1 and C2, and of the surface of the golf ball 2, a region sandwiched between the small circles C1 and C2 is defined.

In FIG. 6, a point P (α) is the point that is located on the surface of the golf ball 2 and of which the central angle with the great circle GC is α° (degree). A point F(α) is a foot of a perpendicular line Pe(α) that extends downward from the point P(α) to the first rotation axis Ax1. What is indicated by an arrow L1(α) is the length of the perpendicular line Pe(α). In other words, the length L1(α) is the distance between the point P(α) and the first rotation axis Ax1. For one cross section, the lengths L1(α) are calculated at 21 points P(α). Specifically, the lengths L1(α) are calculated at angles α of −30°, −27°, −24°, −21°, −18°, −15°, −12°, −9°, −6°, −3°, 0°, 3°, 6°, 9°, 12°, 15°, 18°, 21°, 24°, 27°, and 30°. The 21 lengths L1(α) are summed to obtain a total length L2 (mm). The total length L2 is a parameter dependent on the surface shape in the cross section shown in FIG. 6.

Figure 7:
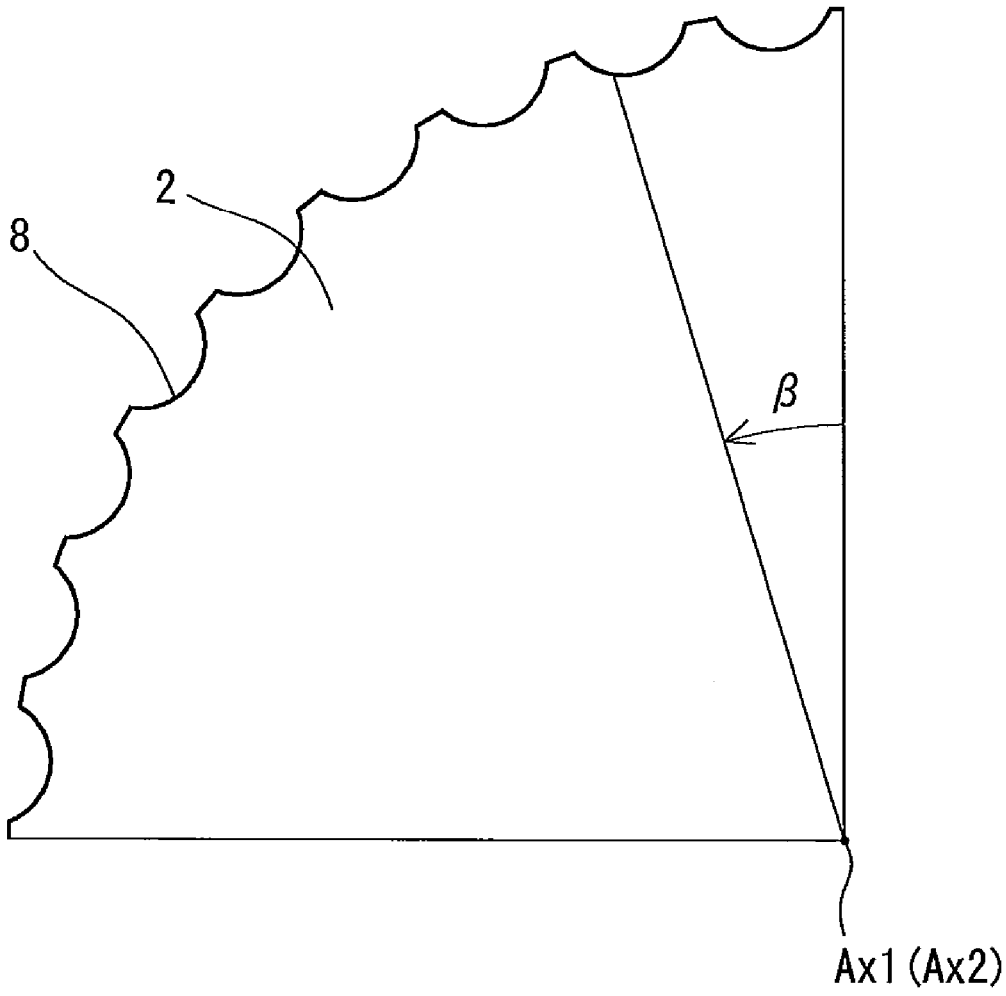
FIG. 7 is a schematic view for explaining the evaluation method in FIG. 5.

FIG. 7 shows a partial cross section of the golf ball 2. In FIG. 7, a direction perpendicular to the surface of the sheet is the direction of the first rotation axis Ax1. In FIG. 7, what is indicated by a reference sign β is a rotation angle of the golf ball 2. In a range equal to or greater than 0° and smaller than 360°, the rotation angles β are set at an interval of an angle of 0.25°. At each rotation angle, the total length L2 is calculated. As a result, 1440 total lengths L2 are obtained along the rotation direction. In other words, a first data constellation regarding a parameter dependent on a surface shape appearing at a predetermined point moment by moment during one rotation of the golf ball 2, is calculated. This data constellation is calculated on the basis of the 30240 lengths L1.

Figure 8:
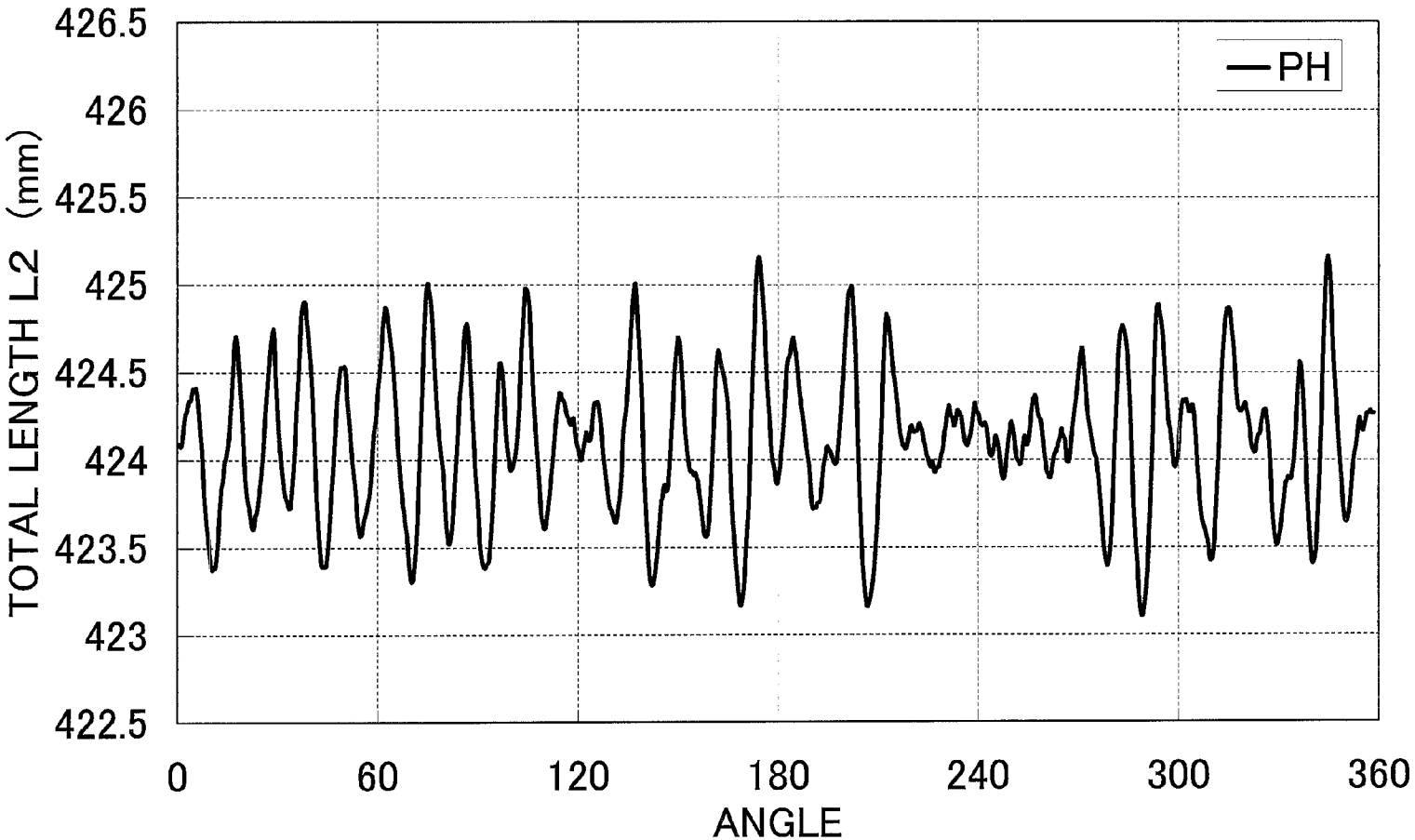
FIG. 8 is a graph showing an evaluation result of the golf ball in FIG. 3.

FIG. 8 shows a graph plotting the first data constellation of the golf ball 2 shown in FIGS. 3 and 4. In this graph, the horizontal axis indicates the rotation angle β, and the vertical axis indicates the total length L2. Fourier transformation is performed on the first data constellation. By the Fourier transformation, a frequency spectrum is obtained. In other words, by the Fourier transformation, a coefficient of a Fourier series represented by the following formula is obtained.

$$F_k = \sum_{n=0}^{N-1}\left(a_n \cos 2\pi\frac{nk}{N} + b_n \sin 2\pi\frac{nk}{N}\right) \quad \text{[Mathematical Formula 1]}$$

The above mathematical formula is a combination of two trigonometric functions having different periods. In the above mathematical formula, $a_n$ and $b_n$ are Fourier coefficients. The magnitude of each component synthesized is determined depending on these Fourier coefficients. Each coefficient is represented by the following mathematical formula.

$$a_n = \frac{1}{N}\sum_{k=0}^{N-1} F_k \cos 2\pi\frac{nk}{N} \quad \text{[Mathematical Formula 2]}$$

$$b_n = \frac{1}{N}\sum_{k=0}^{N-1} F_k \sin 2\pi\frac{nk}{N}$$

In the above mathematical formulas, N is the total number of pieces of data of the first data constellation, and $F_k$ is the kth value in the first data constellation. The spectrum is represented by the following mathematical formula.

$$P_n = \sqrt{a_n^2 + b_n^2} \quad \text{[Mathematical Formula 3]}$$

Figure 9:
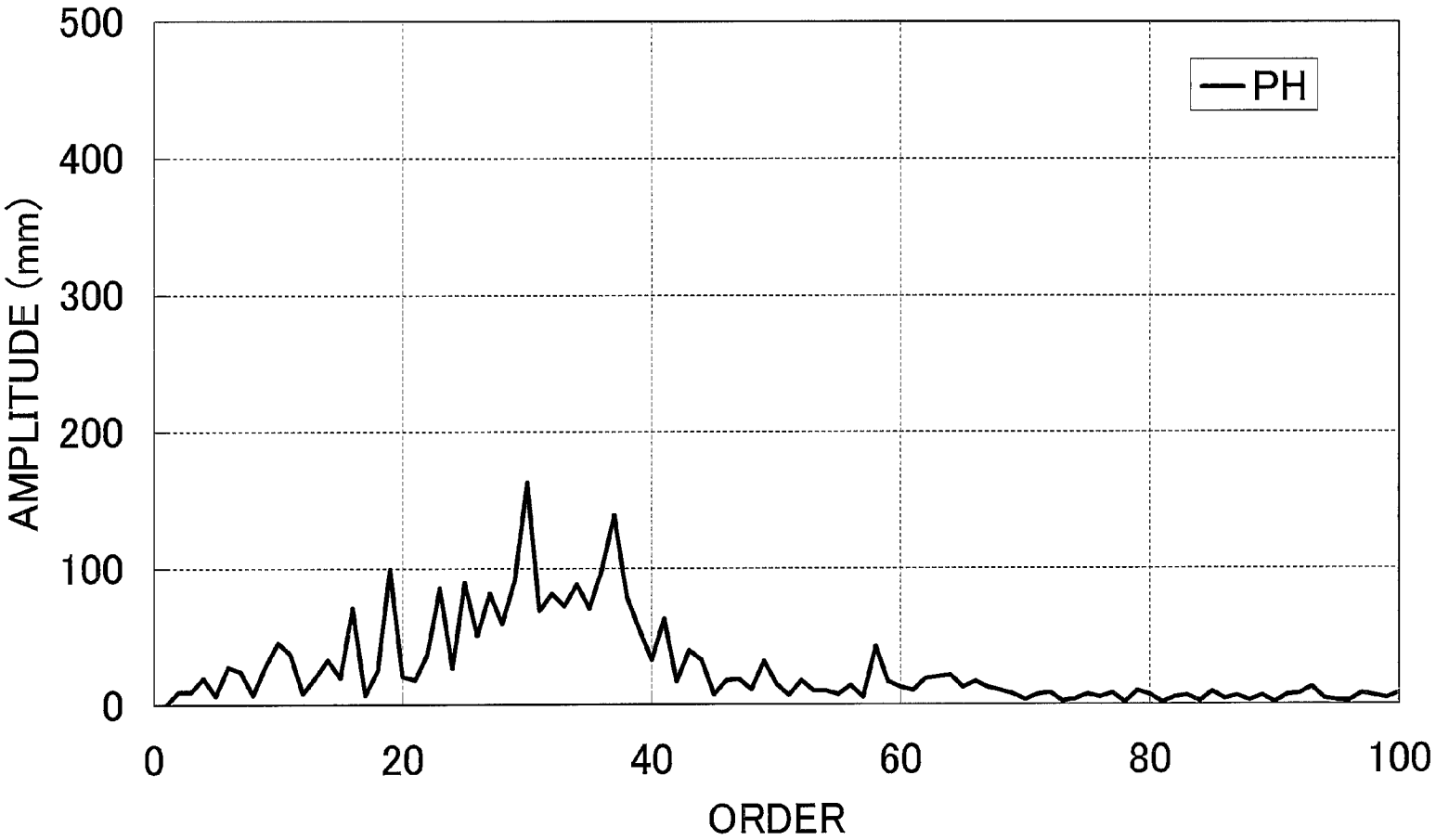
FIG. 9 is a graph showing another evaluation result of the golf ball in FIG. 3.

By the Fourier transformation, a first transformed data constellation is obtained. FIG. 9 shows a graph plotting the first transformed data constellation. In this graph, the horizontal axis indicates an order, and the vertical axis indicates an amplitude. On the basis of this graph, the maximum peak is determined. Further, the peak value Pd1 of the maximum peak and the order Fd1 of the maximum peak are determined. The peak value Pd1 and the order Fd1 are numeric values indicating the aerodynamic characteristic during PH rotation.

Moreover, a second rotation axis Ax2 orthogonal to the first rotation axis Ax1 is determined. Similarly as for PH rotation, for POP rotation, a great circle GC and two small circles C1 and C2 are assumed. Rotation of the golf ball 2 about the second rotation axis Ax2 is referred to as POP rotation. The absolute value of the central angle between the small circle C1 and the great circle GC is 30°. The absolute value of the central angle between the small circle C2 and the great circle GC is also 30°. For a region, sandwiched between the small circles C1 and C2, of the surface of the golf ball 2, 1440 total lengths L2 are calculated. In other words, a second data constellation regarding a parameter dependent on a surface shape appearing at a predetermined point moment by moment during one rotation of the golf ball 2, is calculated.

Figure 10:
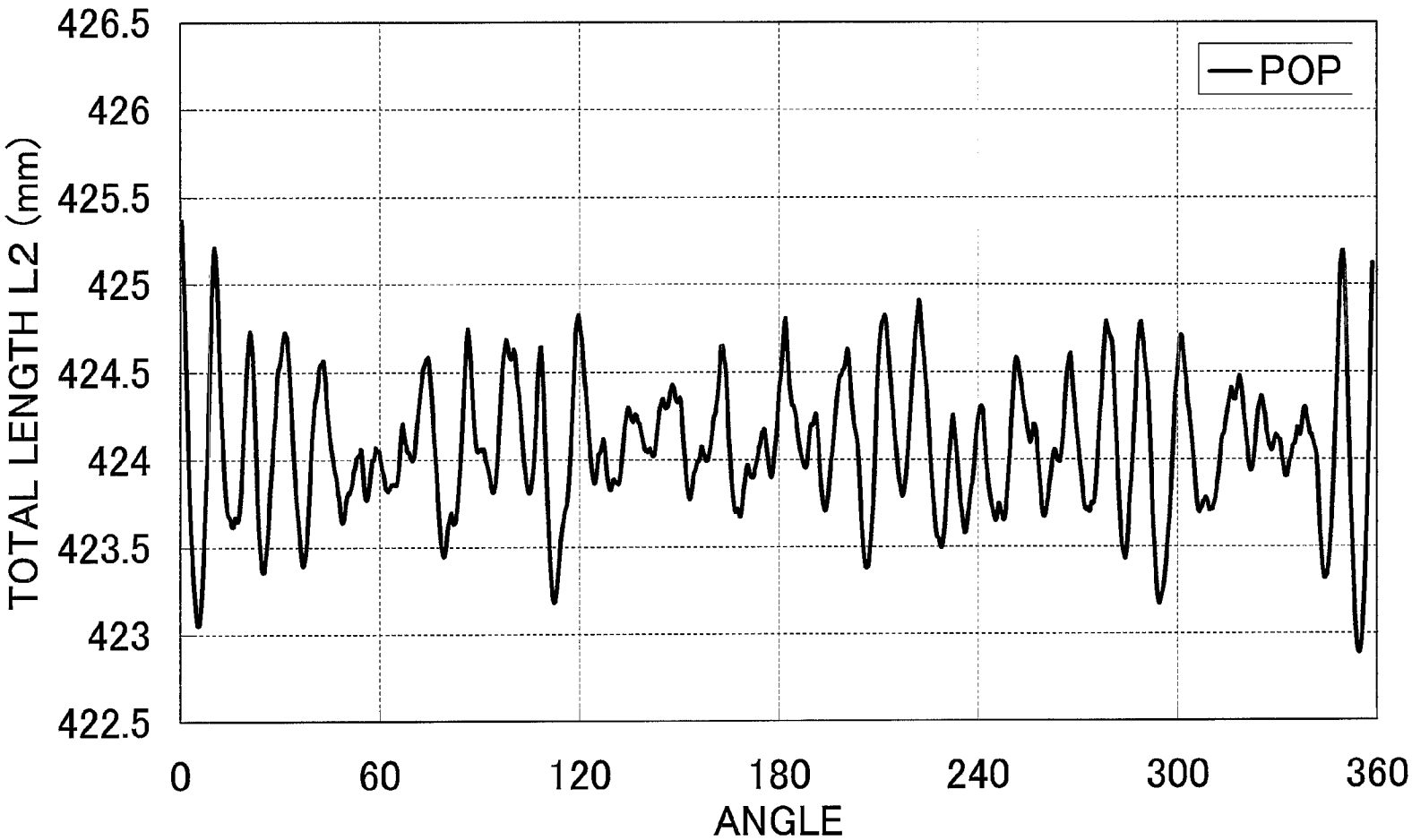
FIG. 10 is a graph showing another evaluation result of the golf ball in FIG. 3.
Figure 11:
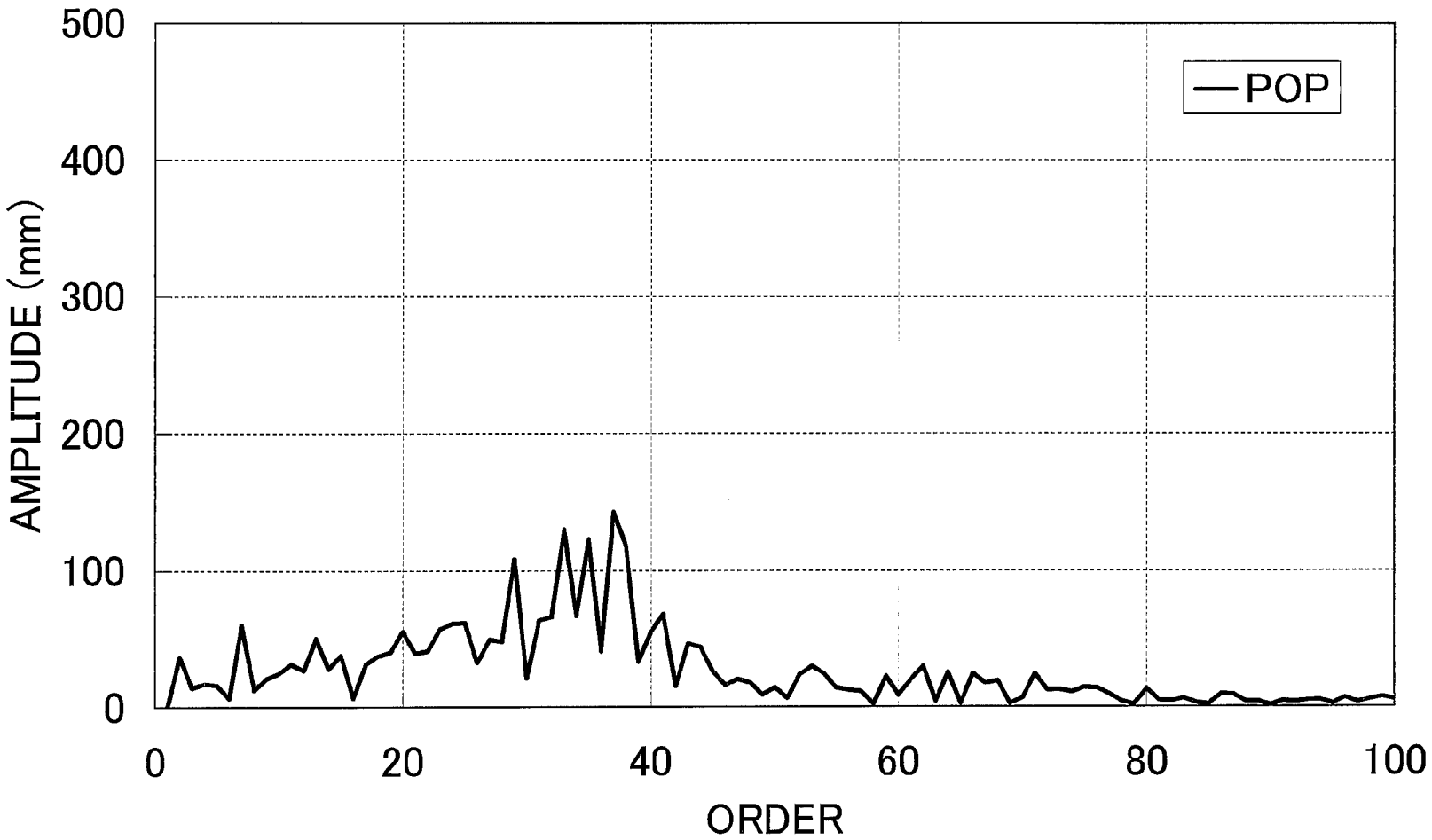
FIG. 11 is a graph showing another evaluation result of the golf ball in FIG. 3.

FIG. 10 shows a graph plotting the second data constellation of the golf ball 2 shown in FIGS. 3 and 4. In this graph, the horizontal axis indicates the rotation angle β, and the vertical axis indicates the total length L2. Fourier transformation is performed on the second data constellation to obtain a second transformed data constellation. FIG. 11 shows a graph plotting the second transformed data constellation. In this graph, the horizontal axis indicates an order, and the vertical axis indicates an amplitude. On the basis of this graph, the maximum peak is determined. Further, the peak value Pd2 of the maximum peak and the order Fd2 of the maximum peak are determined. The peak value Pd2 and the order Fd2 are numeric values indicating the aerodynamic characteristic during POP rotation.

As is obvious from FIGS. 8 to 11, the Fourier transformation facilitates comparison of the aerodynamic characteristic during PH rotation and the aerodynamic characteristic during PO rotation.

There are numerous straight lines orthogonal to the first rotation axis Ax1. A straight line of which the corresponding great circle GC contains the most number of dimple 8 centers substantially located therein is set as the second rotation axis Ax2. When there are in reality a plurality of straight lines of which the corresponding great circles GC each contain the most number of dimple 8 centers substantially located therein, the peak value is calculated for each of the cases where these straight lines are set as second rotation axes Ax2. The maximum value of these peak values is the peak value Pd2.

The following shows a result, of the golf ball 2 shown in FIGS. 3 and 4, calculated by the above evaluation method.

Total volume of the dimples 8: 325 $mm^3$

PH Rotation

Peak value Pd1: 163.1 mm

Order Fd1: 30

POP Rotation

Peak value Pd2: 143.1 mm

Order Fd2: 37

Absolute value of the difference between the peak values Pd1 and Pd2: 20.0 mm Absolute value of the difference between the orders Fd1 and Fd2: 7

The following Table 6 shows the peak values Pd1, the peak values Pd2, the orders Fd1, and the orders Fd2 calculated for commercially available golf balls A-E.

TABLE 6

| | Commercially Available Golf Balls | | | | |
|---|---|---|---|---|---|
| | A | B | C | D | E |
| Pd1 (mm) | 86.7 | 178.8 | 163.6 | 232.6 | 145.5 |
| Pd2 (mm) | 512.3 | 408.4 | 379.8 | 402.5 | 367.2 |
| Absolute value of difference (mm) | 425.6 | 229.6 | 216.2 | 169.9 | 221.7 |
| Fd1 | 55 | 26 | 55 | 25 | 31 |
| Fd2 | 35 | 33 | 35 | 33 | 27 |
| Absolute value of difference | 20 | 7 | 20 | 8 | 4 |
| Pd3 ($mm^3$) | 9.2 | 12.8 | 10.3 | 20.7 | 9.9 |
| Pd4 ($mm^3$) | 41.0 | 36.3 | 30.2 | 30.0 | 28.6 |
| Absolute value of difference ($mm^3$) | 31.8 | 23.5 | 19.9 | 9.3 | 18.7 |
| Fd3 | 13 | 25 | 55 | 13 | 31 |
| Fd4 | 35 | 33 | 35 | 33 | 27 |
| Absolute value of difference | 22 | 8 | 20 | 20 | 4 |

As is obvious from the comparison with the commercially available products, the peak value Pd2 of the golf ball 2 shown in FIGS. 3 and 4 is small. According to the finding by the inventors of the present invention, the golf ball 2 with small peak values Pd1 and Pd2 has a long flight distance. The detailed reason has not been identified, but it is inferred that this is because transition of turbulent flow continues smoothly.

In light of flight distance, each of the peak value Pd1 and the peak value Pd2 is preferably equal to or less than 200 mm, more preferably equal to or less than 180 mm, and particularly preferably equal to or less than 165 mm. It is preferred if the peak value Pd1 and the peak value Pd2 are smaller.

In light of flight distance, each of: the value obtained by dividing the peak value Pd1 by the total volume of the dimples 8; and the value obtained by dividing the peak value Pd2 by the total volume of the dimples 8, is preferably equal to or less than 0.62 $mm^{-2}$, more preferably equal to or less than 0.55 $mm^{-2}$, and particularly preferably equal to or less than 0.51 $mm^{-2}$.

As is obvious from the comparison with the commercially available products, the difference between the peak values Pd1 and Pd2 of the golf ball 2 shown in FIGS. 3 and 4 is small. According to the finding by the inventors, the golf ball 2 with a small difference between the peak values Pd1 and Pd2 has excellent aerodynamic symmetry. It is inferred that this is because the similarity between the surface shape during PH rotation and the surface shape during POP rotation is high and hence the difference between the dimple effect during PH rotation and the dimple effect during POP rotation is small.

In light of aerodynamic symmetry, the absolute value of the difference (Pd1-Pd2) is preferably equal to or less than 50 mm, more preferably equal to or less than 35 mm, and particularly preferably equal to or less than 25 mm. The ideal value of the difference is zero.

In light of aerodynamic symmetry, the value obtained by dividing the absolute value of the difference (Pd1-Pd2) by the total volume of the dimples 8 is preferably equal to or less than 0.15 $mm^{-2}$, more preferably equal to or less than 0.11 $mm^{-2}$, and particularly preferably equal to or less than 0.08 $mm^{-2}$. The ideal value is zero.

In light of flight distance, each of the order Fd1 and the order Fd2 is preferably equal to or greater than 29 and equal to or less than 39. In light of aerodynamic symmetry, the absolute value of the difference (Fd1–Fd2) is preferably equal to or less than 10, more preferably equal to or less than 8, and particularly preferably equal to or less than 7. The ideal value of the difference is zero.

The absolute value of the central angle between the great circle GC and the small circle C1 and the absolute value of the central angle between the great circle GC and the small circle C2 can be arbitrarily set in a range equal to or less than 90°. The smaller the absolute value of the central angle is, the lower the cost for calculation is. On the other hand, if the absolute value of the central angle is excessively small, the accuracy of evaluation becomes insufficient. During flight of the golf ball 2, the region near the great circle GC receives great pressure from the air. The dimples 8 existing in the region contribute greatly to the dimple effect. In this respect, in the evaluation method, the absolute value of the central angle is set at 30°.

The dimples 8 close to the great circle GC contribute greatly to the dimple effect. On the other hand, the dimples 8 distant from the great circle GC contribute slightly to the dimple effect. In this respect, each of many obtained lengths L1($\alpha$) may be multiplied by a coefficient dependent on the angle $\alpha$, to calculate the total length L2. For example, each length L($\alpha$) may be multiplied by sin $\alpha$ to calculate the total length L2.

In the evaluation method, on the basis of the angles $\alpha$ set at an interval of an angle of 3°, many lengths L1($\alpha$) are calculated. The angles α are not necessarily set at an interval of an angle of 3°. The angles α are preferably set at an interval of an angle equal to or greater than 0.1° and equal to or less than 5°. If the angles α are set at an interval of an angle equal to or greater than 0.1°, the computer load is small. If the angles α are set at an interval of an angle equal to or less than 5°, the accuracy of evaluation is high. In light of accuracy, the angles α are set at an interval of an angle more preferably equal to or less than 4° and particularly preferably equal to or less than 3°.

In the evaluation method, on the basis of the angles β set at an interval of an angle of 0.25°, many total lengths L2 are calculated. The angles β are not necessarily set at an interval of an angle of 0.25°. The angles β are preferably set at an interval of an angle equal to or greater than 0.1° and equal to or less than 5°. If the angles β are set at an interval of an angle equal to or greater than 0.1°, the computer load is small. If the angles β are set at an interval of an angle equal to or less than 5°, the accuracy of evaluation is high. In light of accuracy, the angles β are set at an interval of an angle more preferably equal to or less than 3° and particularly preferably equal to or less than 1°. The position of a point (start point) at which the angle β is first measured does not affect the peak value and the order. Thus, the start point can be arbitrarily set.

In the evaluation method, the first data constellation and the second data constellation are calculated on the basis of the lengths L1(α). The lengths L1(α) are parameters dependent on the distance between the rotation axis (Ax1 or Ax2) and the surface of the golf ball 2. Other parameters dependent on the surface shape of the golf ball 2 may be used. Examples of the other parameters include (a) Distance between the surface of the phantom sphere 12 and the surface of the golf ball 2; and (b) Distance between the surface and the center O (see FIG. 6) of the golf ball 2.

The golf ball 2 may be evaluated on the basis of only the first data constellation obtained by rotation about the first rotation axis Ax1. The golf ball 2 may be evaluated on the basis of only the second data constellation obtained by rotation about the second rotation axis Ax2. Preferably, the golf ball 2 is evaluated on the basis of both the first data constellation and the second data constellation. Preferably, the aerodynamic symmetry of the golf ball 2 is evaluated by the comparison of the first data constellation and the second data constellation.

A data constellation may be obtained on the basis of an axis other than the first rotation axis Ax1 and the second rotation axis Ax2. The positions and the number of rotation axes can be arbitrarily set. Preferably, on the basis of two rotation axes, two data constellations are obtained. Evaluation based on two data constellations is superior in accuracy to that based on one data constellation. The evaluation based on two data constellations can be done in a shorter time than that based on three or more data constellations. When evaluation based on two data constellations is done, two rotation axes may not be orthogonal to each other.

As a result of thorough research by the inventors of the present invention, it is confirmed that, when evaluation is done on the basis of both PH rotation and POP rotation, the result has a high correlation with the flight performance of the golf ball. The reason is inferred as follows:

(a) The region near the seam is a unique region, and PH rotation is most affected by this region;

(b) POP rotation is unlikely to be affected by this region; and (c) By the evaluation based on both PH rotation and POP rotation, an objective result is obtained.

The evaluation based on both PH rotation and POP rotation is preferred from the standpoint that conformity to the rules established by the USGA can be determined.

In a designing process according to the present invention, the positions of numerous dimples located on the surface of the golf ball 2 are decided. Specifically, the latitude and longitude of each dimple 8 are decided. In addition, the shape of each dimple 8 is decided. This shape includes diameter, depth, curvature radius of a cross section, and the like. The aerodynamic characteristic of the golf ball 2 is evaluated by the above method. For example, the above peak values Pd1 and Pd2 and the above orders Fd1 and Fd2 are calculated, and their magnitudes are evaluated. Further, the difference between the peak values Pd1 and Pd2 and the difference between the orders Fd1 and Fd2 are evaluated. If the aerodynamic characteristic is insufficient, the positions and the shapes of the dimples 8 are changed. After the change, evaluation is done again. In this designing process, the golf ball 2 can be evaluated without producing a mold.

The following will describe another evaluation method according to the present invention. In the evaluation method, similarly as in the aforementioned evaluation method, a first rotation axis Ax1 (see FIG. 5) is assumed. The first rotation axis Ax1 passes through the two poles Po of the golf ball 2. The golf ball 2 rotates about the first rotation axis Ax1. This rotation is referred to as PH rotation. In addition, a great circle GC, a small circle C1, and a small circle C2 which are orthogonal to the first rotation axis Ax1 are assumed. The absolute value of the central angle between the small circle C1 and the great circle GC is 30°. The absolute value of the central angle between the small circle C2 and the great circle GC is also 30°. The surface of the golf ball 2 is divided at the small circles C1 and C2, and of this surface, a region sandwiched between the small circles C1 and C2 is defined.

Figure 12:
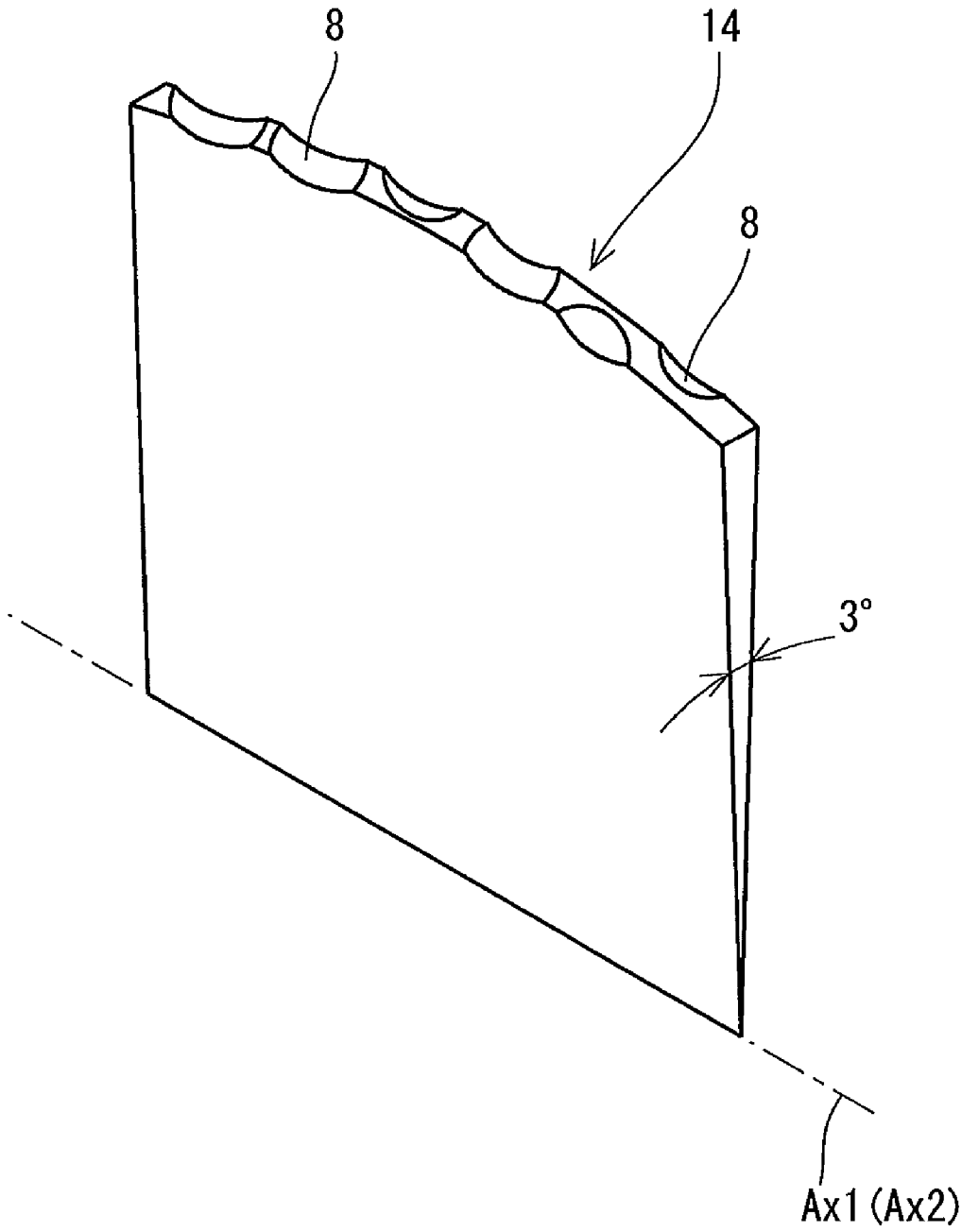
FIG. 12 is a schematic view for explaining an evaluation method according to an alternative embodiment of the present invention.
Figure 13:
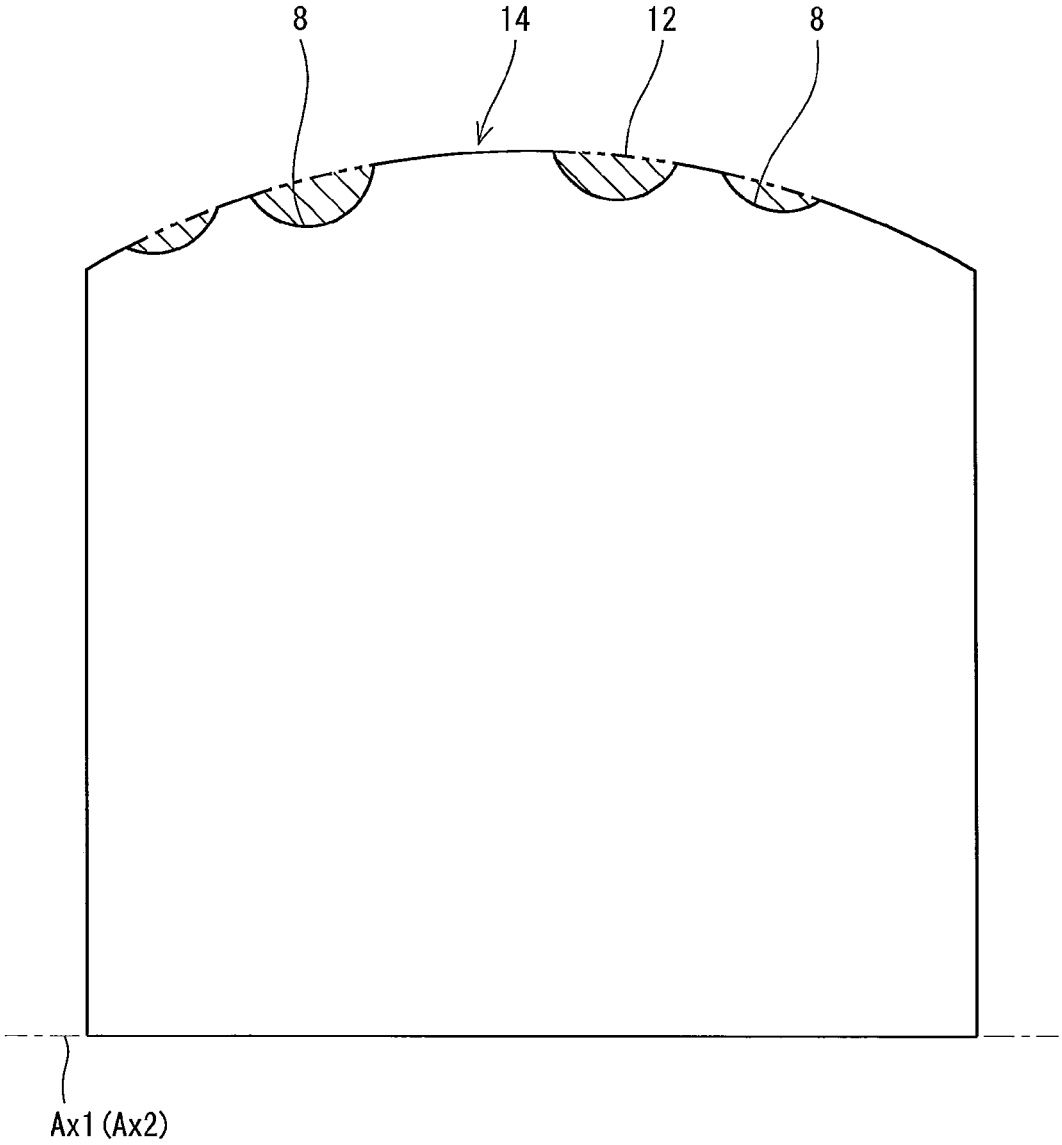
FIG. 13 is a schematic view for explaining the evaluation method in FIG. 12.

This region is divided at an interval of a central angle of 3° in the rotation direction into 120 minute regions. FIG. 12 shows one minute region 14. FIG. 13 is an enlarged cross-sectional view of the minute region 14 in FIG. 12. For the minute region 14, the volume of the space between the surface of the phantom sphere 12 and the surface of the golf ball 2 is calculated. This volume is the volume of parts hatched in FIG. 13. The volume is calculated for each of the 120 minute regions 14. In other words, 120 volumes along the rotation direction when the golf ball 2 makes one rotation are calculated. These volumes are a first data constellation regarding a parameter dependent on a surface shape appearing at a predetermined point moment by moment during one rotation of the golf ball 2.

Figure 14:
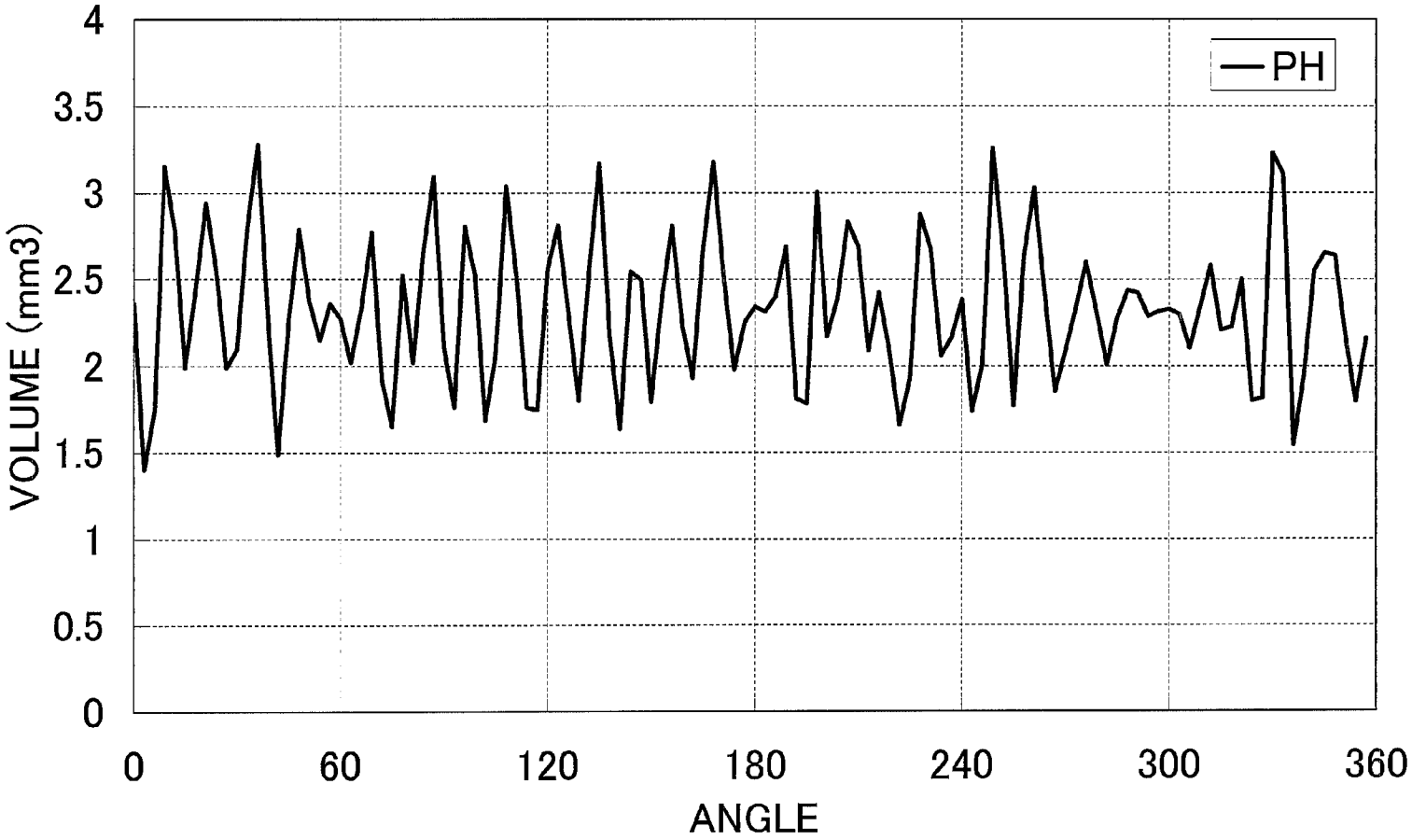
FIG. 14 is a graph showing another evaluation result of the golf ball in FIG. 3.
Figure 15:
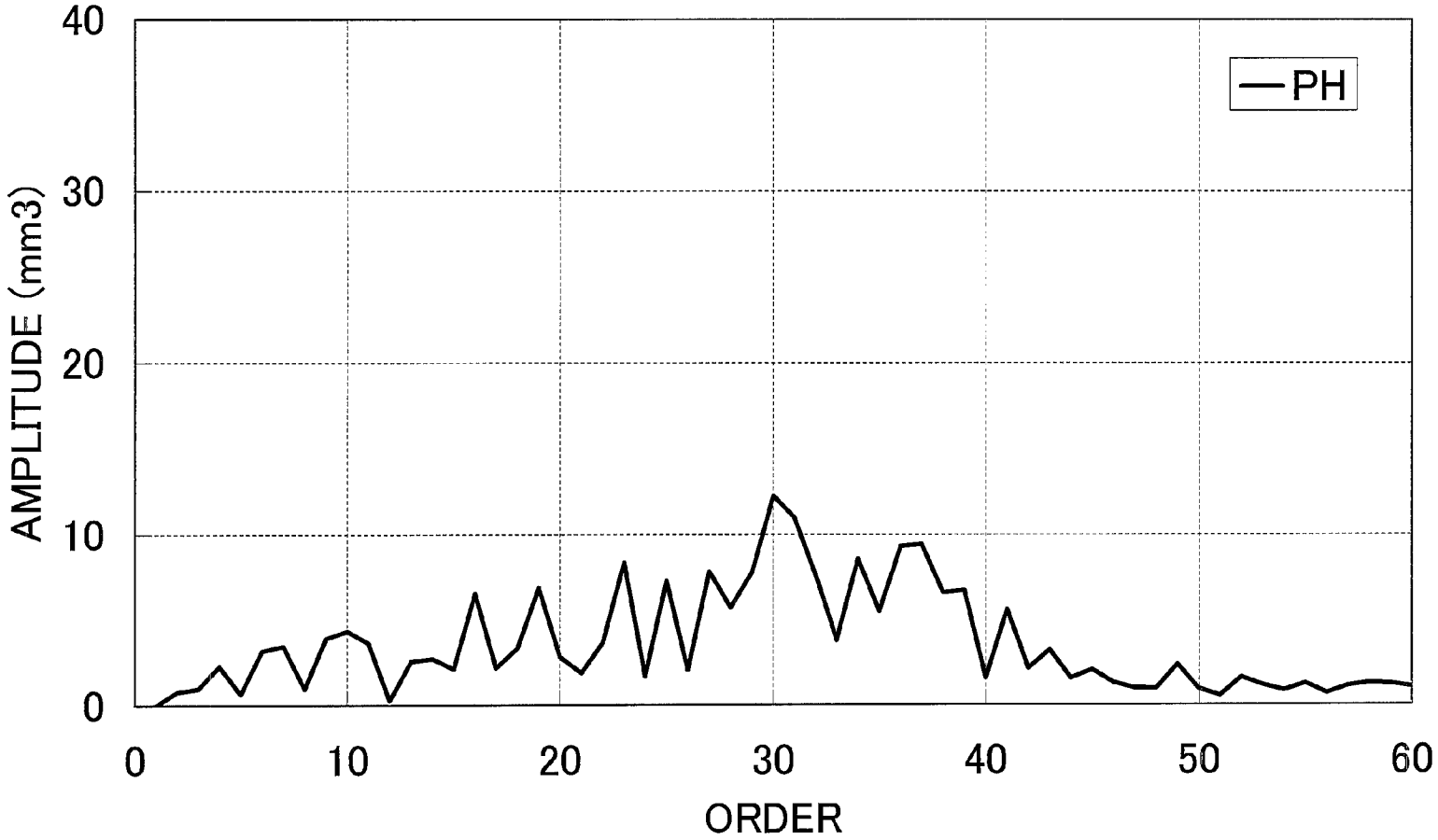
FIG. 15 is a graph showing another evaluation result of the golf ball in FIG. 3.

FIG. 14 shows a graph plotting the first data constellation of the golf ball 2 shown in FIGS. 3 and 4. In this graph, the horizontal axis indicates the angle in the rotation direction, and the vertical axis indicates the volume for the minute region. Fourier transformation is performed on the first data constellation. By the Fourier transformation, a first transformed data constellation is obtained. FIG. 15 shows a graph plotting the first transformed data constellation. In this graph, the horizontal axis indicates an order, and the vertical axis indicates an amplitude. On the basis of this graph, the maximum peak is determined. Further, the peak value Pd3 of the maximum peak and the order Fd3 of the maximum peak are determined. The peak value Pd3 and the order Fd3 are numeric values indicating the aerodynamic characteristic during PH rotation.

Moreover, a second rotation axis Ax2 orthogonal to the first rotation axis Ax1 is determined. The rotation of the golf ball 2 about the second rotation axis Ax2 is referred to as POP rotation. For POP rotation, similarly as for PH rotation, a great circle GC and two small circles C1 and C2 are assumed. The absolute value of the central angle between the small circle C1 and the great circle GC is 30°. The absolute value of the central angle between the small circle C2 and the great circle GC is also 30°. Of the surface of the golf ball 2, a region sandwiched between these small circles C1 and C2 is divided at an interval of a central angle of 3° in the rotation direction into 120 minute regions 14. For each minute region 14, the volume of the space between the surface of the phantom sphere 12 and the surface of the golf ball 2 is calculated. In other words, a second data constellation regarding a parameter dependent on a surface shape appearing at a predetermined point moment by moment during one rotation of the golf ball 2, is calculated.

Figure 16:
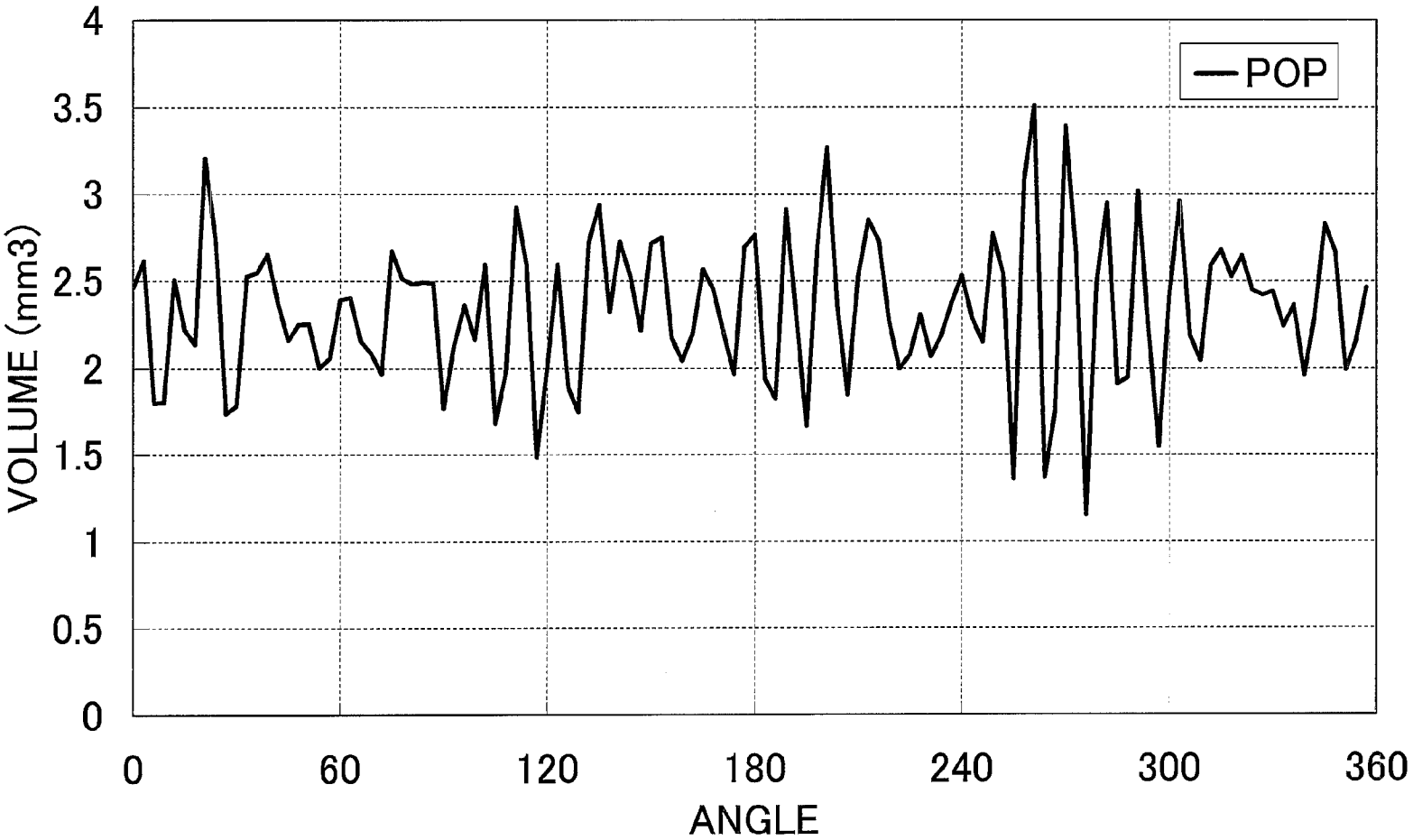
FIG. 16 is a graph showing another evaluation result of the golf ball in FIG. 3.
Figure 17:
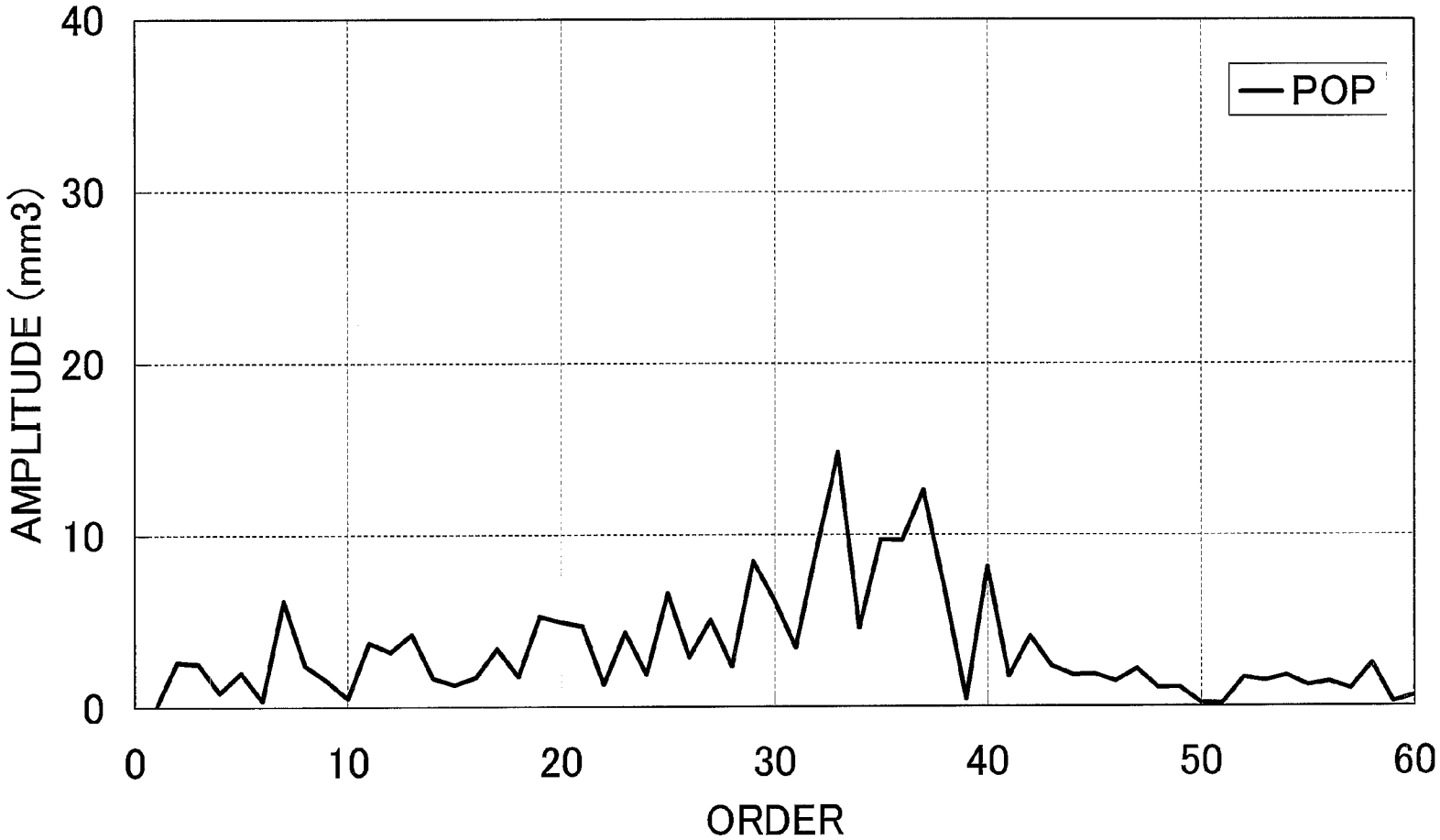
FIG. 17 is a graph showing another evaluation result of the golf ball in FIG. 3.

FIG. 16 shows a graph plotting the second data constellation of the golf ball 2 shown in FIGS. 3 and 4. In this graph, the horizontal axis indicates the angle in the rotation direction, and the vertical axis indicates the volume for the minute region. Fourier transformation is performed on the second data constellation. By the Fourier transformation, a second transformed data constellation is obtained. FIG. 17 shows a graph plotting the second transformed data constellation. On the basis of this graph, the maximum peak is determined. Further, the peak value Pd4 of the maximum peak and the order Fd4 of the maximum peak are determined. The peak value Pd4 and the order Fd4 are numeric values indicating the aerodynamic characteristic during POP rotation.

There are numerous straight lines orthogonal to the first rotation axis Ax1. A straight line of which the corresponding great circle GC contains the most number of dimple 8 centers substantially located therein is set as the second rotation axis Ax2. When there are in reality a plurality of straight lines of which the corresponding great circles GC each contain the most number of dimple 8 centers substantially located therein, the peak value is calculated for each of the cases where these straight lines are set as second rotation axes Ax2. The maximum value of these peak values is the peak value Pd4.

The following shows a result, of the golf ball 2 shown in FIGS. 3 and 4, calculated by the above evaluation method.

Total volume of the dimples 8: 325 $mm^3$

PH Rotation

Peak value Pd3: 12.2 $mm^3$

Order Fd3: 30

POP Rotation

Peak value Pd4: 14.8 $mm^3$

Order Fd4: 33

Absolute value of the difference between the peak values Pd3 and Pd4: 2.6 $mm^3$ Absolute value of the difference between the orders Fd3 and Fd4: 3

The above Table 6 shows the peak values Pd3, the peak values Pd4, the orders Fd3, and the orders Fd4 calculated for the commercially available golf balls A-E.

As is obvious from the comparison with the commercially available products, the peak value Pd4 of the golf ball 2 shown in FIGS. 3 and 4 is small. According to the finding by the inventors of the present invention, the golf ball 2 with small peak values Pd3 and Pd4 has a long flight distance. The detailed reason has not been identified, but it is inferred that this is because transition of turbulent flow continues smoothly.

In light of flight distance, each of the peak value Pd3 and the peak value Pd4 is preferably equal to or less than 20 $mm^3$, more preferably equal to or less than 17 $mm^3$, and particularly preferably equal to or less than 15 $mm^3$. It is preferred if the peak value Pd3 and the peak value Pd4 are smaller.

In light of flight distance, each of: the value obtained by dividing the peak value Pd3 by the total volume of the dimples 8; and the value obtained by dividing the peak value Pd4 by the total volume of the dimples 8, is preferably equal to or less than 0.062, more preferably equal to or less than 0.052, and particularly preferably equal to or less than 0.046.

As is obvious from the comparison with the commercially available products, the difference between the peak values Pd3 and Pd4 of the golf ball 2 shown in FIGS. 3 and 4 is small. According to the finding by the inventors, the golf ball 2 with a small difference between the peak values Pd3 and Pd4 has excellent aerodynamic symmetry. It is inferred that this is because the difference between the dimple effect during PH rotation and the dimple effect during POP rotation is small.

In light of aerodynamic symmetry, the absolute value of the difference (Pd3−Pd4) is preferably equal to or less than 5 $mm^3$, more preferably equal to or less than 4 $mm^3$, and particularly preferably equal to or less than 3 $mm^3$. The ideal value of the difference is zero.

In light of flight distance, each of the order Fd3 and the order Fd4 is preferably equal to or greater than 29 and equal to or less than 35. In light of aerodynamic symmetry, the absolute value of the difference (Fd3−Fd4) is preferably equal to or less than 6, more preferably equal to or less than 5, and particularly preferably equal to or less than 4. The ideal value of the difference is zero.

The absolute value of the central angle between the great circle GC and the small circle C1 and the absolute value of the central angle between the great circle GC and the small circle C2 can be arbitrarily set in a range equal to or less than 90°. The smaller the absolute value of the central angle is, the lower the cost for calculation is. On the other hand, if the absolute value of the central angle is excessively small, the accuracy of evaluation becomes insufficient. During flight of the golf ball 2, the region near the great circle GC receives great pressure from the air. The dimples 8 existing in the region contribute greatly to the dimple effect. In this respect, in the evaluation method, the absolute value of the central angle is set at 30°.

In the evaluation method, the region is divided at an interval of a central angle of 3° in the rotation direction into the 120 minute regions 14. The region is not necessarily divided at an interval of a central angle of 3° in the rotation direction. The region is preferably divided at an interval of a central angle equal to or greater than 0.1° and equal to or less than 5°. If the region is divided at an interval of a central angle equal to or greater than 0.1°, the computer load is small. If the region is divided at an interval of a central angle equal to or less than 5°, the accuracy of evaluation is high. In light of accuracy, the region is divided at an interval of a central angle preferably equal to or less than 4° and particularly preferably equal to or less than 3°. The position of a point (start point) at which the central angle is first measured does not affect the peak value and the order. Thus, the start point can be arbitrarily set.

In the evaluation method, the first data constellation and the second data constellation are calculated on the basis of the volumes for the minute regions 14. Other parameters dependent on the surface shape of the golf ball 2 may be used for calculating data constellations. Examples of the other parameters include:

(a) Volume of the minute region 14 in the golf ball 2;

(b) Volume between a plane including the edge of each dimple 8 and the surface of the golf ball 2 in the minute region 14;

(c) Area between the surface of the phantom sphere 12 and the surface of the golf ball 2 in front view of the minute region 14;

(d) Area between a plane including the edge of each dimple 8 and the surface of the golf ball 2 in front view of the minute region 14; and (e) Area of the golf ball 2 in front view of the minute region 14.

The golf ball 2 may be evaluated on the basis of only the first data constellation obtained by rotation about the first rotation axis Ax1. The golf ball 2 may be evaluated on the basis of only the second data constellation obtained by rotation about the second rotation axis Ax2. Preferably, the golf ball 2 is evaluated on the basis of both the first data constellation and the second data constellation. Preferably, the aerodynamic symmetry of the golf ball 2 is evaluated by the comparison of the first data constellation and the second data constellation.

A data constellation may be obtained on the basis of an axis other than the first rotation axis Ax1 and the second rotation axis Ax2. The positions and the number of rotation axes can be arbitrarily set. Preferably, on the basis of two rotation axes, two data constellations are obtained. Evaluation based on two data constellations is superior in accuracy to that based on one data constellation. The evaluation based on two data constellations can be done in a shorter time than that based on three or more data constellations. When evaluation based on two data constellations is done, two rotation axes may not be orthogonal to each other.

As a result of thorough research by the inventors of the present invention, it is confirmed that, when evaluation is done on the basis of both PH rotation and POP rotation, the result has a high correlation with the flight performance of the golf ball. The reason is inferred as follows:

(a) The region near the seam is a unique region, and PH rotation is most affected by this region;

(b) POP rotation is unlikely to be affected by this region; and (c) By the evaluation based on both PH rotation and POP rotation, an objective result is obtained.

The evaluation based on both PH rotation and POP rotation is preferred from the standpoint that conformity to the rules established by the USGA can be determined.

In a designing process according to the present invention, the positions of numerous dimples located on the surface of the golf ball 2 are decided. Specifically, the latitude and longitude of each dimple 8 are decided. In addition, the shape of each dimple 8 is decided. This shape includes diameter, depth, curvature radius of a cross section, and the like. The aerodynamic characteristic of the golf ball 2 is evaluated by the above method. For example, the above peak values Pd3 and Pd4 and the above orders Fd3 and Fd4 are calculated, and their magnitudes are evaluated. Further, the difference between the peak values Pd3 and Pd4 and the difference between the orders Fd3 and Fd4 are evaluated. If the aerodynamic characteristic is insufficient, the positions and the shapes of the dimples 8 are changed. After the change, evaluation is done again. In this designing process, the golf ball 2 can be evaluated without producing a mold.

EXAMPLES

Example

A rubber composition was obtained by kneading 100 parts by weight of a polybutadiene (trade name "BR-730", available from JSR Corporation), 30 parts by weight of zinc diacrylate, 6 parts by weight of zinc oxide, 10 parts by weight of barium sulfate, 0.5 parts by weight of diphenyl disulfide, and 0.5 parts by weight of dicumyl peroxide. This rubber composition was placed into a mold including upper and lower mold halves each having a hemispherical cavity, and heated at 170° C. for 18 minutes to obtain a core with a diameter of 39.7 mm. On the other hand, a resin composition was obtained by kneading 50 parts by weight of an ionomer resin (trade name "Himilan 1605", available from Du Pont-MITSUI POLYCHEMICALS Co., LTD.), 50 parts by weight of another ionomer resin (trade name "Himilan 1706", available from Du Pont-MITSUI POLYCHEMICALS Co., LTD.), and 3 parts by weight of titanium dioxide. The above core was placed into a final mold having numerous pimples on its inside face, followed by injection of the above resin composition around the core by injection molding, to form a cover with a thickness of 1.5 mm. Numerous dimples having a shape that was the inverted shape of the pimples were formed on the cover. A clear paint including a two-component curing type polyurethane as a base material was applied to this cover to obtain a golf ball of Example with a diameter of 42.7 mm and a weight of about 45.4 g. The golf ball has a PGA compression of about 85. The golf ball has the dimple pattern shown in FIGS. 3 and 4. The detailed specifications of the dimples are shown in the following Table 7.

Comparative Example

Figure 18:
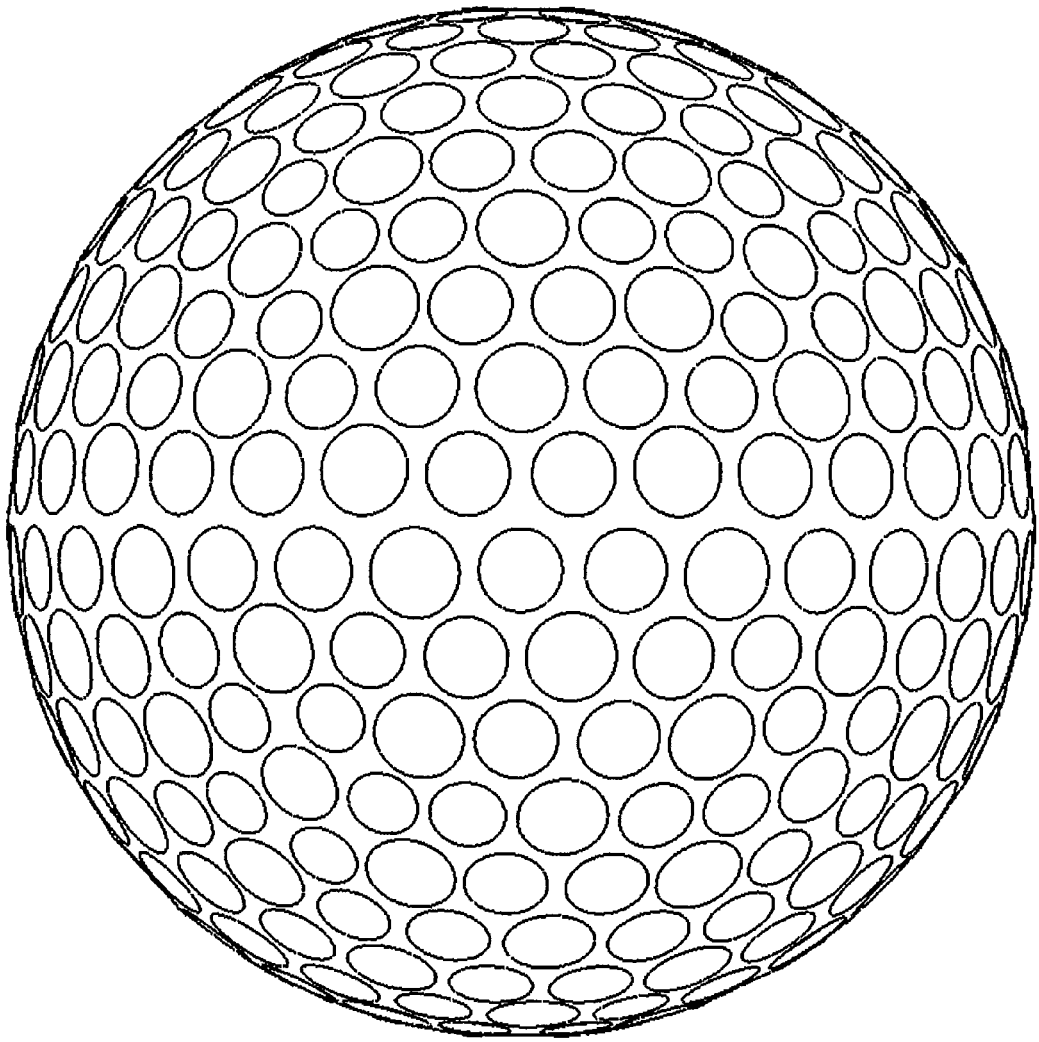
FIG. 18 is a front view of a golf ball according to Comparative Example.
Figure 19:
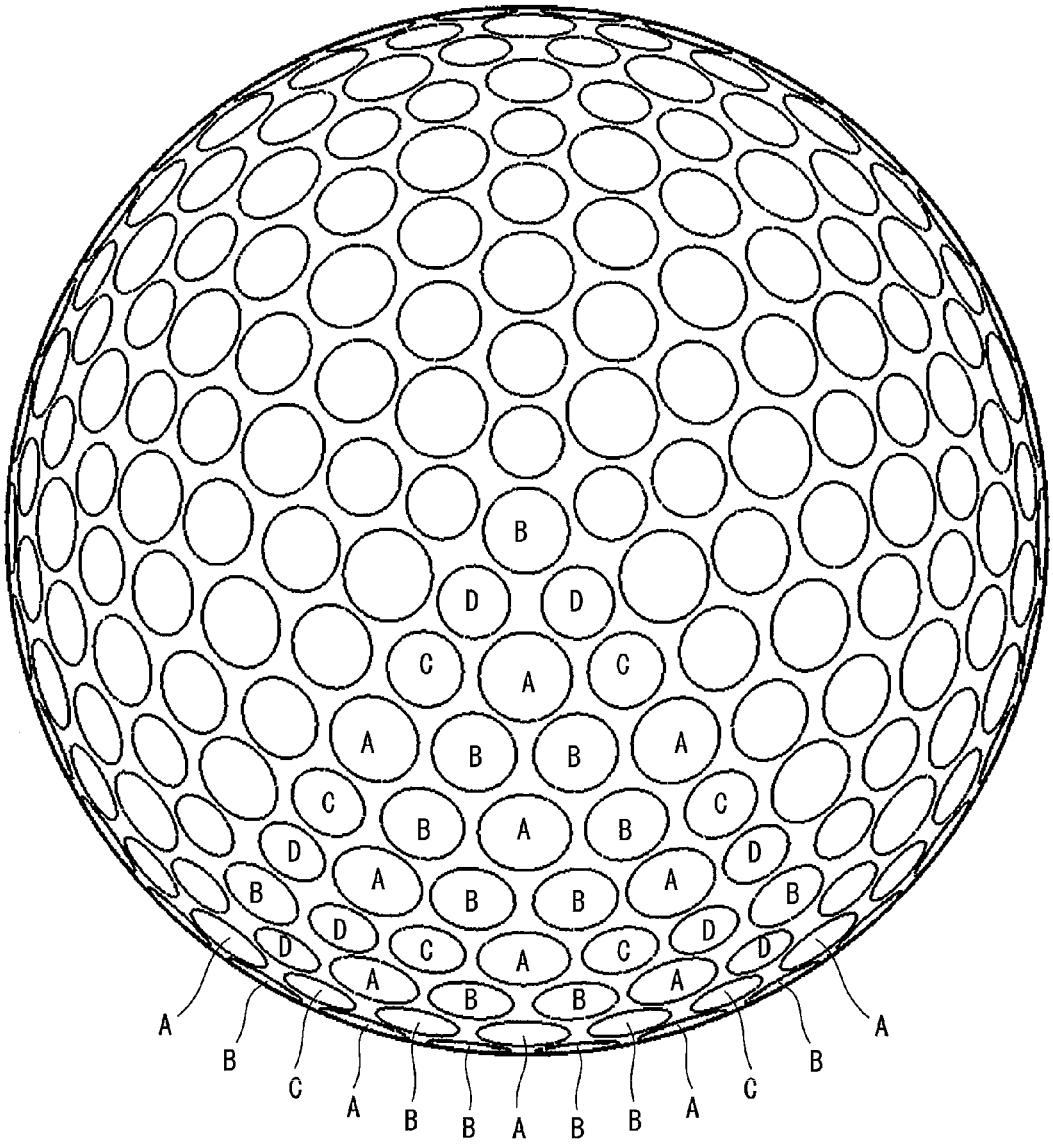
FIG. 19 is a plan view of the golf ball in FIG. 18.

A golf ball of Comparative Example was obtained in a similar manner as Example, except the final mold was changed so as to form dimples whose specifications are shown in the following Table 7. FIG. 18 is a front view of the golf ball of Comparative Example, and FIG. 19 is a plan view of the golf ball. For one unit when a northern hemisphere of the golf ball is divided into 5 units, the latitude and longitude of the dimples are shown in the following Table 8. The dimple pattern of this unit is developed to obtain the dimple pattern of the northern hemisphere. The dimple pattern of a southern hemisphere is equivalent to the dimple pattern of the northern hemisphere. The dimple patterns of the northern hemisphere and the southern hemisphere are shifted from each other by 5.98° in the latitude direction. The dimple pattern of the southern hemisphere is obtained by symmetrically moving the dimple pattern of the northern hemisphere relative to the equator after shifting the dimple pattern of the northern hemisphere by 5.98° in the longitude direction. The following table 9 shows the peak values Pd1 to Pd4 and the orders Fd1 to Fd4 of this golf ball.

TABLE 7

Specifications of Dimples

| | Kind | Number | Diameter (mm) | Depth (mm) | Volume ($mm^3$) |
|---|---|---|---|---|---|
| Example | A | 216 | 4.20 | 0.1436 | 0.971 |
| | B | 84 | 3.80 | 0.1436 | 0.881 |
| | C | 72 | 3.00 | 0.1436 | 0.507 |
| | D | 12 | 2.60 | 0.1436 | 0.389 |
| Compara. | A | 120 | 3.80 | 0.1711 | 0.973 |
| Example | B | 152 | 3.50 | 0.1711 | 0.826 |
| | C | 60 | 3.20 | 0.1711 | 0.691 |
| | D | 60 | 3.00 | 0.1711 | 0.607 |

TABLE 8

| Dimple Arrangement of Comparative Example | | | |
|---|---|---|---|
| | Kind | Latitude (degree) | Longitude (degree) |
| 1 | A | 73.693 | 0.000 |
| 2 | A | 60.298 | 36.000 |
| 3 | A | 54.703 | 0.000 |
| 4 | A | 43.128 | 22.848 |
| 5 | A | 4.960 | 0.000 |
| 6 | A | 24.656 | 18.496 |
| 7 | A | 5.217 | 0.000 |
| 8 | A | 14.425 | 36.000 |
| 9 | A | 5.763 | 18.001 |
| 10 | B | 90.000 | 0.000 |
| 11 | B | 64.134 | 13.025 |
| 12 | B | 53.502 | 19.337 |
| 13 | B | 44.629 | 8.044 |
| 14 | B | 30.596 | 36.000 |
| 15 | B | 24.989 | 6.413 |
| 16 | B | 15.335 | 12.237 |
| 17 | B | 5.360 | 5.980 |
| 18 | B | 5.360 | 30.020 |
| 19 | C | 70.742 | 36.000 |
| 20 | C | 49.854 | 36.000 |
| 21 | C | 34.619 | 13.049 |
| 22 | C | 14.610 | 23.917 |
| 23 | D | 80.183 | 36.000 |
| 24 | D | 40.412 | 36.000 |
| 25 | D | 33.211 | 24.550 |
| 26 | D | 22.523 | 29.546 |

[Flight Distance Test]

A driver with a titanium head (Trade name "XXIO", available from SRI Sports Limited, shaft hardness: R, loft angle: 12°) was attached to a swing machine available from True Temper Co. A golf ball was hit under the conditions of: a head speed of 40 m/sec; a launch angle of about 13°; and a backspin rotation rate of about 2500 rpm, and the carry and total distances were measured. At the test, the weather was almost windless. The average values of 20 measurements for each of PH rotation and POP rotation are shown in the following Table 9.

TABLE 9

Figure 20:
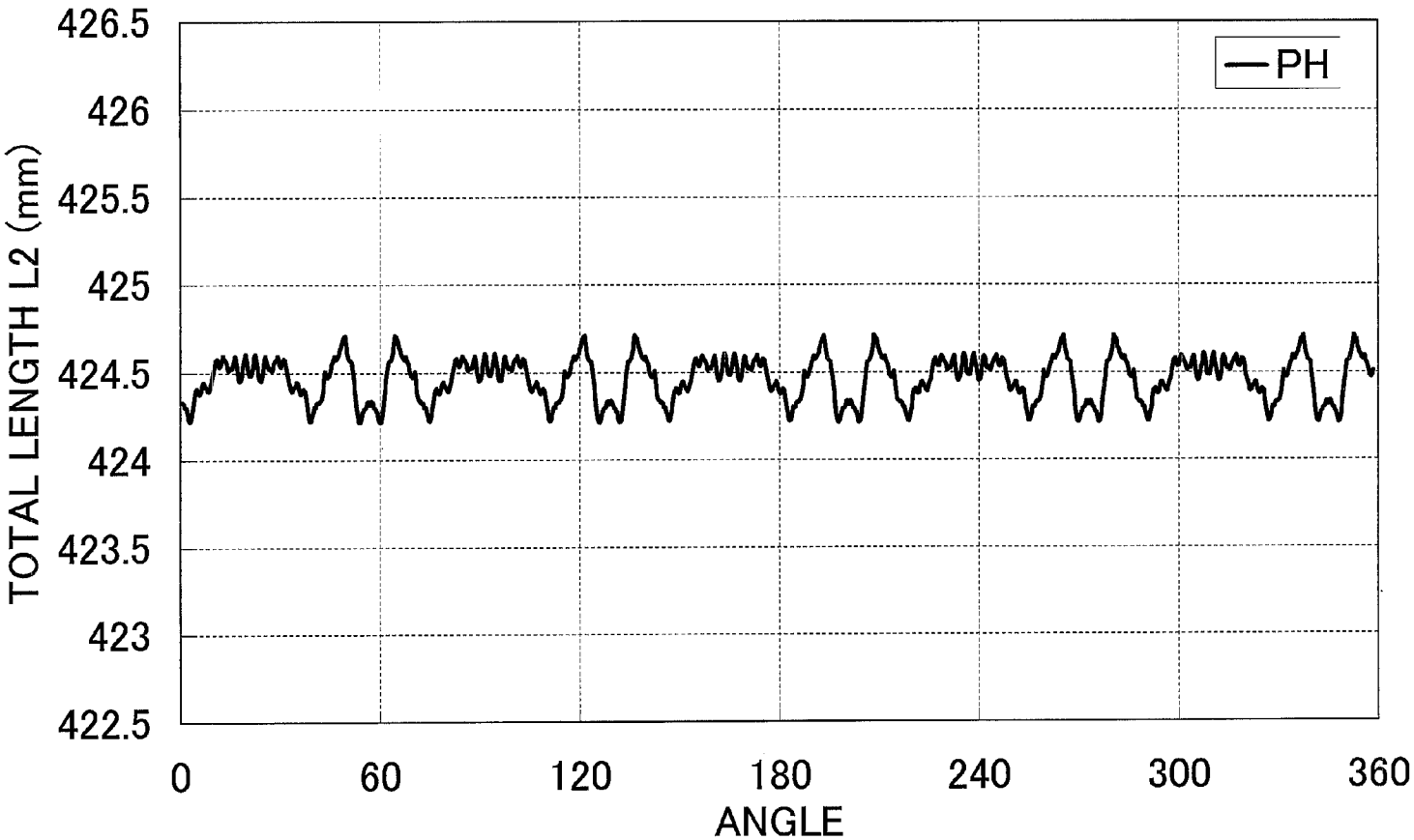
FIG. 20 is a graph showing an evaluation result of the golf ball in FIG. 18.
Figure 21:
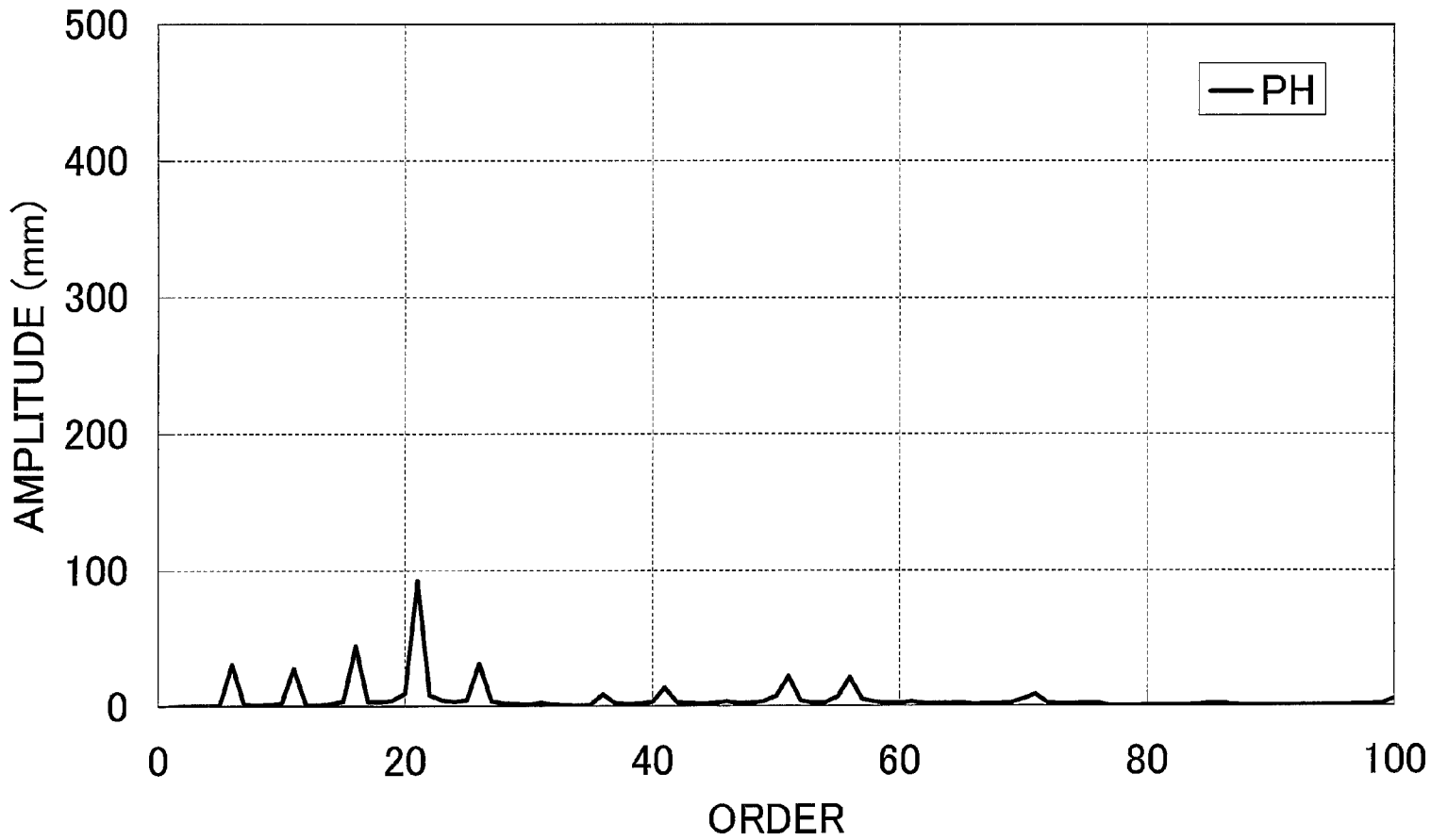
FIG. 21 is a graph showing another evaluation result of the golf ball in FIG. 18.
Figure 22:
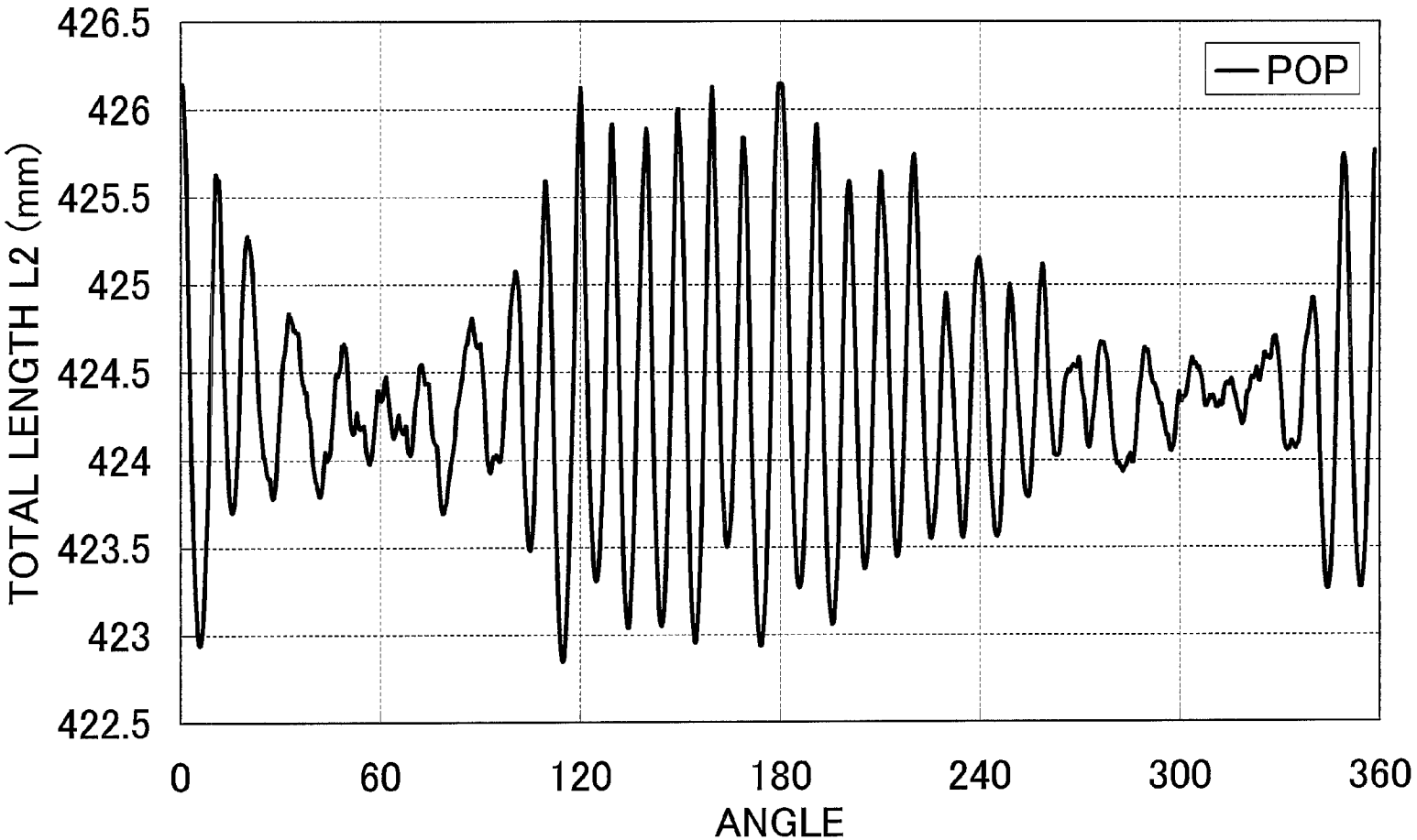
FIG. 22 is a graph showing another evaluation result of the golf ball in FIG. 18.
Figure 23:
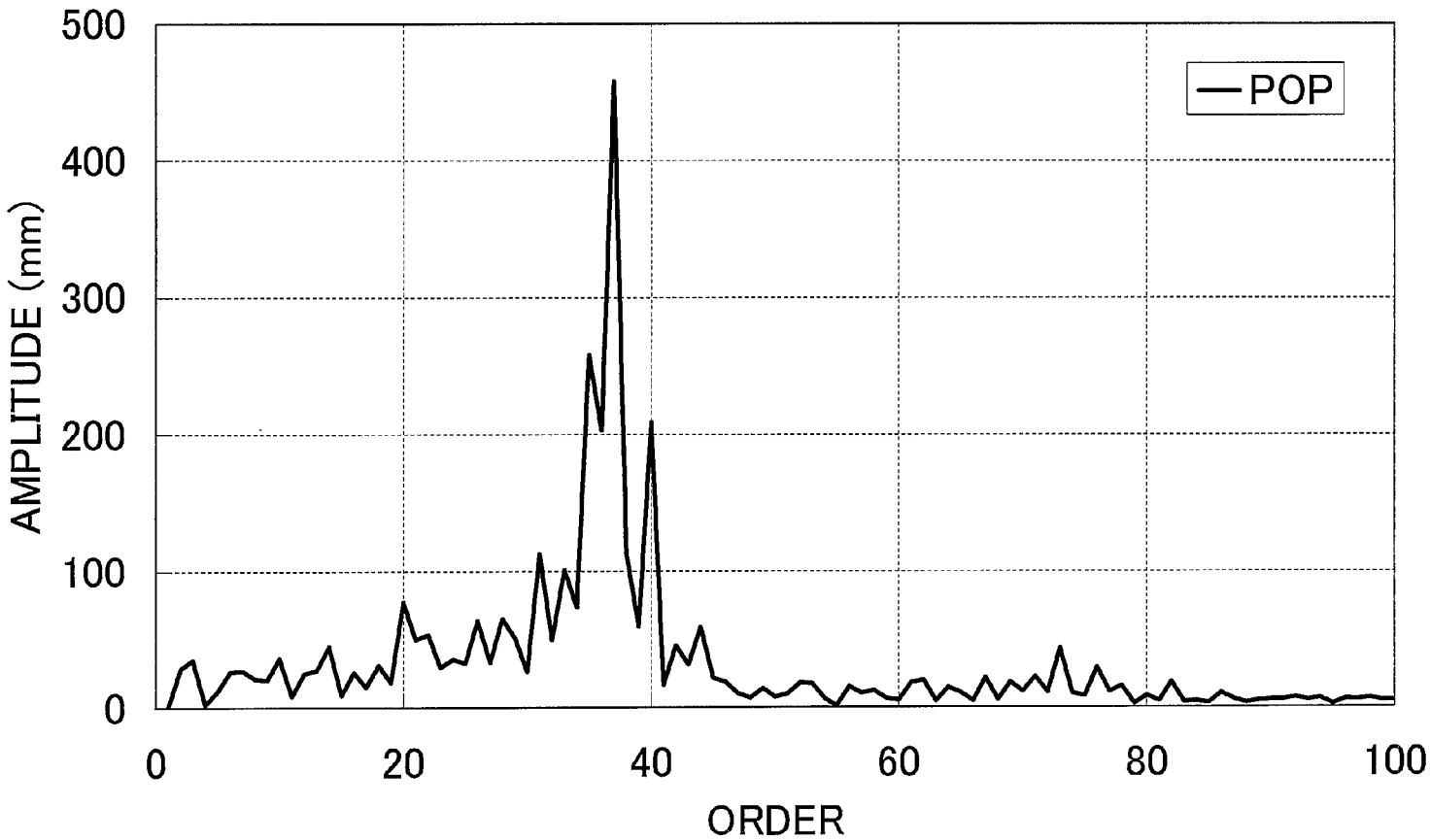
FIG. 23 is a graph showing another evaluation result of the golf ball in FIG. 18.
Figure 24:
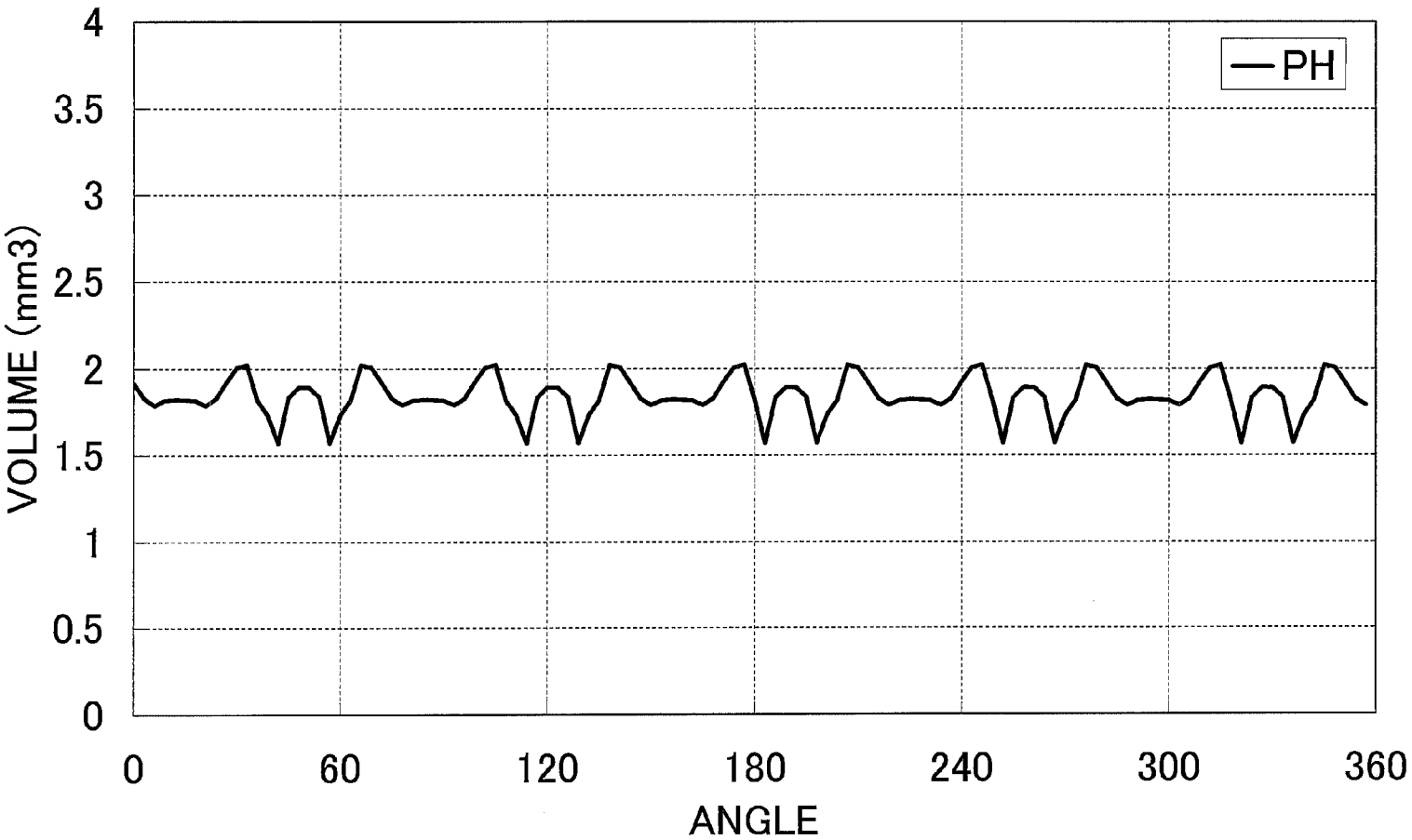
FIG. 24 is a graph showing another evaluation result of the golf ball in FIG. 18.
Figure 25:
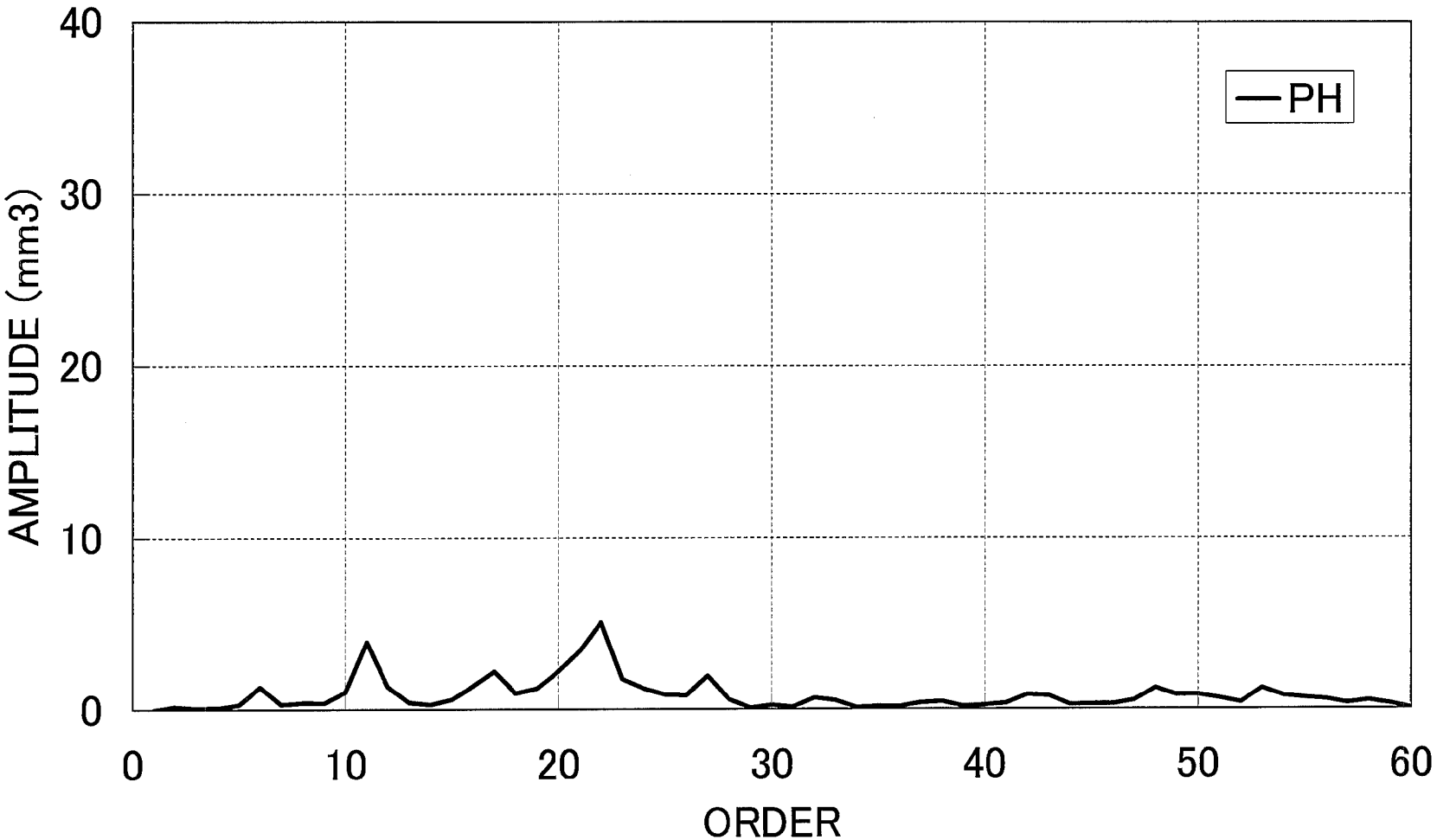
FIG. 25 is a graph showing another evaluation result of the golf ball in FIG. 18.

| Results of Evaluation | | | |
|---|---|---|---|
| | | Example | Compa. Example |
| Front view | | FIG. 3 | FIG. 18 |
| Plan view | | FIG. 4 | FIG. 19 |
| Total number | | 384 | 392 |
| Total volume ($mm^3$) | | 325 | 320 |
| Occupation ratio (%) | | 79 | 65.2 |
| Total length | First data constellation (PH) | FIG. 8 | FIG. 20 |
| | First transformed data constellation (PH) | FIG. 9 | FIG. 21 |
| | Second data constellation (POP) | FIG. 10 | FIG. 22 |
| | Second transformed data constellation (POP) | FIG. 11 | FIG. 23 |
| | Pd1 (mm) | 163.1 | 92.1 |
| | Pd2 (mm) | 143.1 | 458.1 |
| | Absolute value of difference (mm) | 20.0 | 366 |
| | Fd1 | 30 | 21 |
| | Fd2 | 37 | 37 |
| | Absolute value of difference | 7 | 16 |
| Volume | First data constellation (PH) | FIG. 14 | FIG. 24 |
| | First transformed data constellation (PH) | FIG. 15 | FIG. 25 |

TABLE 9-continued

Figure 26:
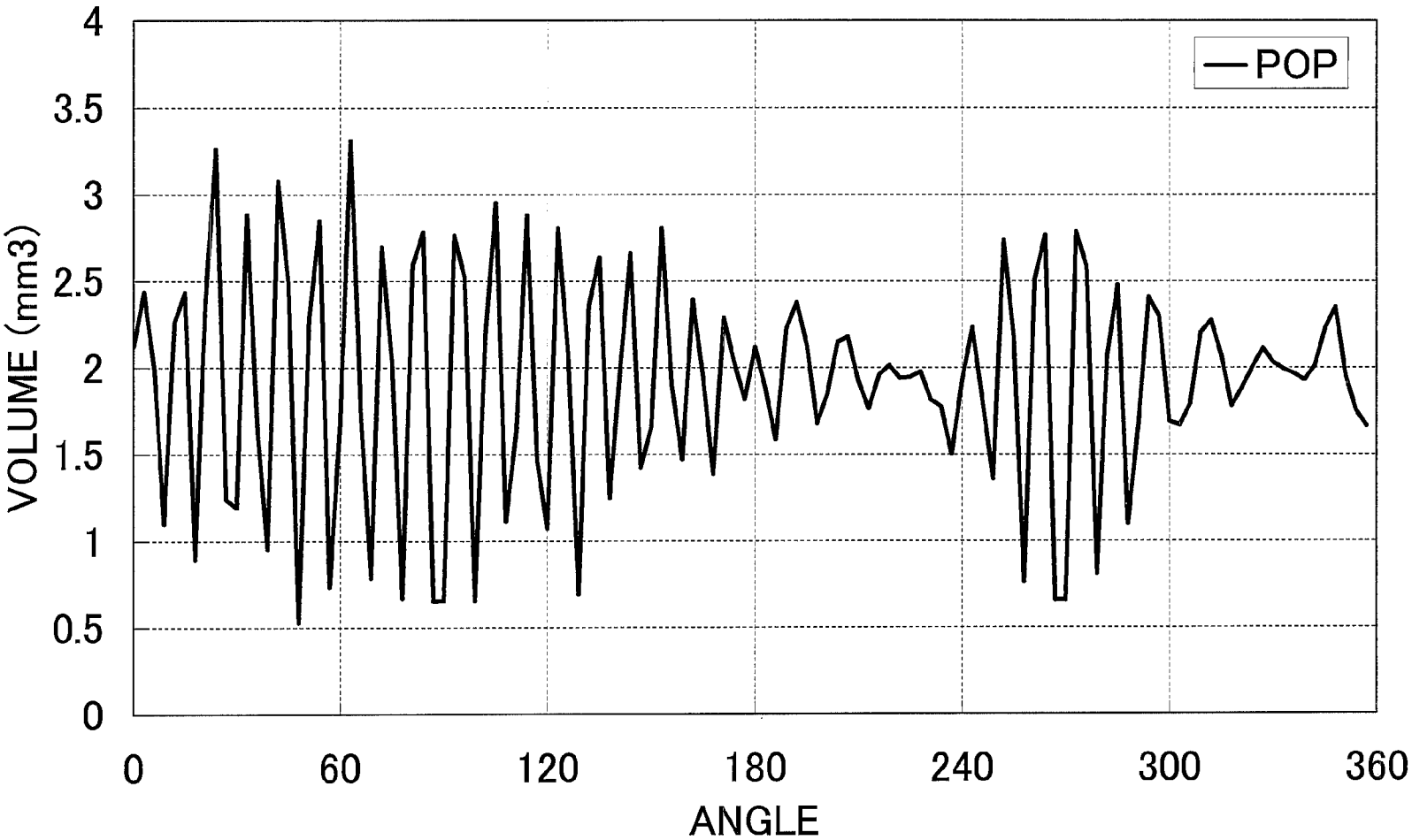
FIG. 26 is a graph showing another evaluation result of the golf ball in FIG. 18.
Figure 27:
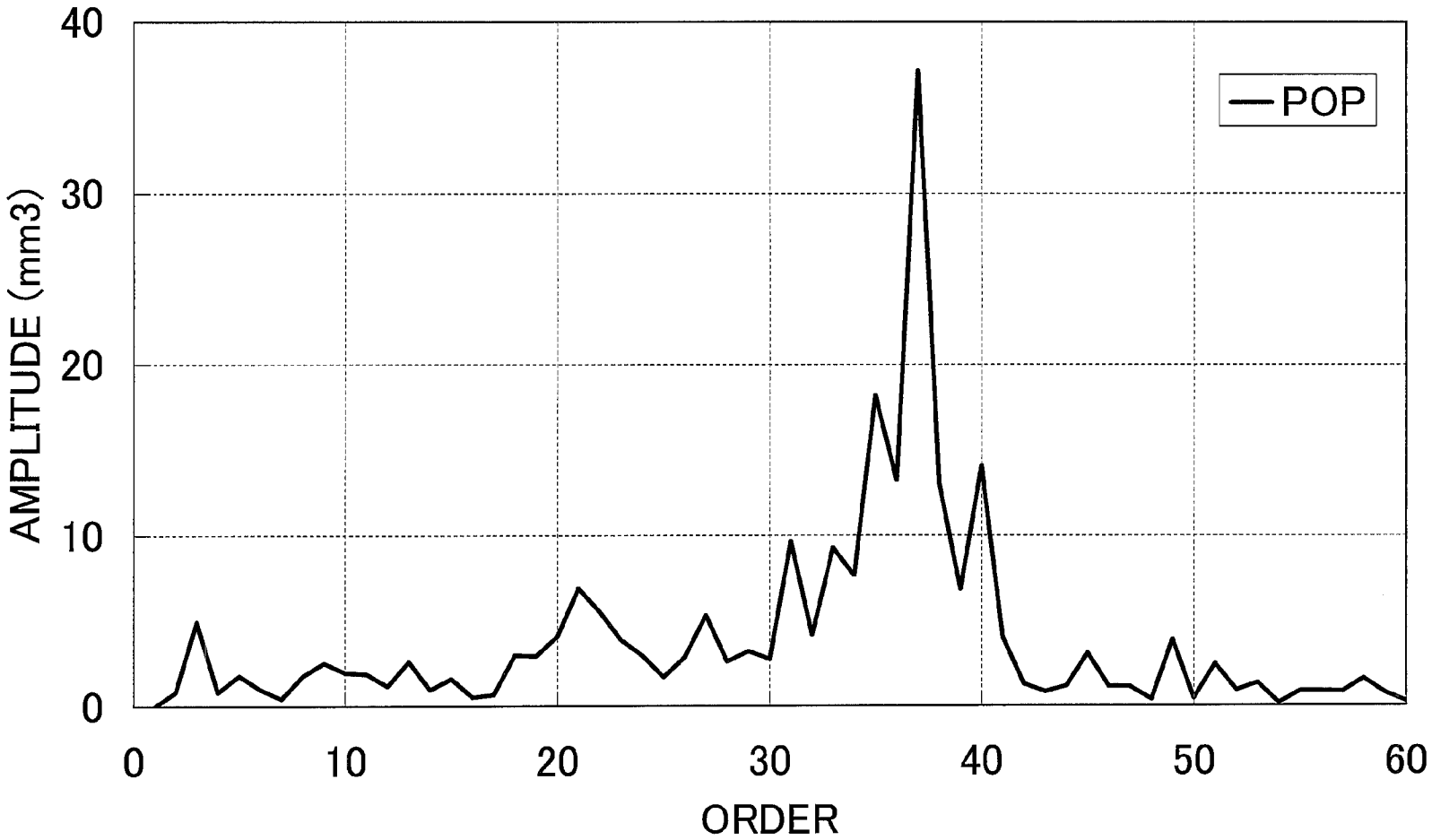
FIG. 27 is a graph showing another evaluation result of the golf ball in FIG. 18.

| Results of Evaluation | | | |
|---|---|---|---|
| | | Example | Compa. Example |
| | Second data constellation (POP) | FIG. 16 | FIG. 26 |
| | Second transformed data constellation (POP) | FIG. 17 | FIG. 27 |
| | Pd3 ($mm^3$) | 12.2 | 5.1 |
| | Pd4 ($mm^3$) | 14.8 | 37.2 |
| | Absolute value of difference ($mm^3$) | 2.6 | 32.1 |
| | Fd3 | 30 | 22 |
| | Fd4 | 33 | 37 |
| | Absolute value of difference | 3 | 15 |
| Carry (m) | PH | 204.4 | 204.0 |
| | POP | 202.4 | 198.8 |
| | Difference | 2.0 | 5.2 |
| Total (m) | PH | 212.8 | 214.0 |
| | POP | 212.1 | 204.3 |
| | Difference | 0.7 | 9.7 |

As shown in Table 9, the flight distance of the golf ball of Example is greater than that of the golf ball of Comparative Example. It is inferred that this is because, in the golf ball of Example, transition of turbulent flow continues smoothly. Further, in the golf ball of Example, the difference between the flight distance at PH rotation and the flight distance at POP rotation is small. It is inferred that this is because the difference between the dimple effect during PH rotation and the dimple effect during POP rotation is small. From the results of evaluation, advantages of the present invention are clear.

The method according to the present invention can be implemented by using a computer. The method may be implemented without using a computer. The gist of the present invention is not dependent on the hardware and software of a computer.

The dimple pattern described above is applicable to a one-piece golf ball, a multi-piece golf ball, and a thread-wound golf ball, in addition to a two-piece golf ball.

The above description is merely for illustrative examples, and various modifications can be made without departing from the principles of the present invention.

What is claimed is:

1. A process for designing a golf ball, the process comprising the steps of:

deciding positions and shapes of numerous dimples located on a surface of a golf ball;

calculating a data constellation regarding a parameter dependent on a surface shape of the golf ball, on the basis of a surface shape appearing at a predetermined point moment by moment during rotation of the golf ball;

performing Fourier transformation on the data constellation to obtain a transformed data constellation;

determining an aerodynamic characteristic of the golf ball on the basis of the transformed data constellation; and changing the positions or the shapes of the dimples when the aerodynamic characteristic is insufficient.

2. The process according to claim 1, wherein at the determination step, the aerodynamic characteristic of the golf ball is determined on the basis of a peak value and an order of a maximum peak of the transformed data constellation.

3. The process according to claim 1, wherein at the calculation step, the data constellation is calculated throughout one rotation of the golf ball.

4. The process according to claim 1, wherein at the calculation step, the data constellation is calculated on the basis of a shape of a surface near a great circle orthogonal to an axis of the rotation.

5. The process according to claim 1, wherein at the calculation step, the data constellation is calculated on the basis of a parameter dependent on a distance between an axis of the rotation and the surface of the golf ball.

6. The process according to claim 1, wherein at the calculation step, the data constellation is calculated on the basis of a parameter dependent on a volume of space between a surface of a phantom sphere and the surface of the golf ball.

* * * * *